US005655352A

United States Patent [19]

Murakami

[11] Patent Number: 5,655,352

[45] Date of Patent: *Aug. 12, 1997

[54] STORAGE DEVICE FOR WRAPPING (SHOPPING) BAGS

[75] Inventor: Toshiyuki Murakami, Sagamihara, Japan

[73] Assignees: Kabushiki Kaisha Muraharu Seisakusho, Sagamihara; Nikura Scales Co., Ltd.; Kabushiki Kaisha Yakult Honsha, both of Tokyo, all of Japan

[ * ] Notice: The term of this patent shall not extend beyond the expiration date of Pat. No. 5,526,631.

[21] Appl. No.: 256,292

[22] PCT Filed: Dec. 22, 1993

[86] PCT No.: PCT/JP93/01853

§ 371 Date: Nov. 7, 1994

§ 102(e) Date: Nov. 7, 1994

[87] PCT Pub. No.: WO94/14661

PCT Pub. Date: Jul. 7, 1994

[30] Foreign Application Priority Data

| | | | |
|---|---|---|---|
| Dec. 22, 1992 | [JP] | Japan | 4-092370 U |
| Jun. 30, 1993 | [JP] | Japan | 5-041131 U |
| Nov. 26, 1993 | [JP] | Japan | 5-321070 |
| Nov. 26, 1993 | [JP] | Japan | 5-321071 |

[51] Int. Cl.[6] ..... B65B 43/38

[52] U.S. Cl. ..... 53/384.1; 53/390

[58] Field of Search ..... 53/390, 570, 571, 53/572, 255, 258; 248/95, 99, 100

[56] References Cited

U.S. PATENT DOCUMENTS

| | | | |
|---|---|---|---|
| 2,899,788 | 8/1959 | Beebe | 53/570 |
| 3,468,100 | 9/1969 | Rubel | 53/572 |
| 3,783,580 | 1/1974 | Raudys | 53/572 |
| 3,896,605 | 7/1975 | Chevalier | 53/570 |
| 4,253,292 | 3/1981 | Lipes | 53/572 |
| 4,368,608 | 1/1983 | Ray | 53/572 |
| 4,370,845 | 2/1983 | Perolls et al. | 53/572 |
| 4,791,776 | 12/1988 | Jackman et al. | 53/570 |
| 5,526,631 | 6/1996 | Murakami | 53/390 |

*Primary Examiner*—John Sipos
*Assistant Examiner*—Gene L. Kim
*Attorney, Agent, or Firm*—Armstrong, Westerman, Hattori, McLeland & Naughton

[57] ABSTRACT

A storage device for wrapping long and narrow items, such as loaves of French bread, green onions, umbrellas and other articles of similar dimensions, including a device body into which a plurality of wrapping bags are stored and means for opening such wrapping bags, one after the other, positioning an item to be stored therein and for removing such wrapping bag, with such item wrapped therein from such storage device.

1 Claim, 23 Drawing Sheets

13
4
6
12
5
11
23
24
25
22
22a
22b
5a
26

STORAGE DEVICE FOR WRAPPING (SHOPPING) BAGS

BACKGROUND OF THE INVENTION

1. Field of the Invention

The present invention relates to a storage device for wrapping bags in order to wrap comparatively long and narrow items.

2. Description of the Prior Art

When people buy food stuffs, and the like, at a grocery store, shop or department store, the buyers traditionally puts the items in a bag (for storing) in order to carry them. In this case, many of the shopping bags are comparatively short. Therefore, items, which are long and narrow in shape, for example, French bread, and the like, are not wrapped to carry or are just put in a wrapping bag, or another large bag, without adequate wrapping.

It is not, however, desirable for food hygiene that unwrapped food stuffs are carried in an unwrapped state without using any shopping bags and/or that unwrapped food stuffs are carried together with wrapped items. With regard to this need, an automatic wrapping machine can be considered to wrap food stuffs by means of wrapping bags. However, there are some problems to solve. One of the problems is the complex structure of an automatic machine, as a result of using negative pressure suction as a means for opening the wrapping bags, a number of links and cam mechanism such machines require. In addition, because a vacuum pump or a motor is used in the prior arts, the production cost increases and such a machine cannot be used where the power source is not accessible. Power cords are a hindrance.

In consideration of the aforementioned problems, the present invention is proposed to provide with simple structure storage device to wrap comparatively long and narrow items, such as French bread, in a wrapping bag.

SUMMARY OF THE INVENTION

The storage device in the present invention comprises: a plurality of wrapping bags for wrapping comparatively long and narrow items; a device body in which such a plurality of wrapping bags are stored; and a means which opens openings of said wrapping bags in order to insert said items into such bags. The storage device is structured so that said plurality of wrapping bags are firstly stored in a box and the box is filled into the device body.

The wrapping bags, which are used for the storage device of the present invention, have openings at the upper end. Such upper end, on the fore side of the opening, is folded and the upper end, of the rear side is projected higher than the position of the fore side. Locking holes are provided at the upper edge of the projected portion.

As the preferred embodiment of the present invention, the wrapping bags are applicable to long and narrow items, for example, food stuffs, such as French bread, and green onions, but not to limited to these items, and are applicable to a variety of daily necessities, such as umbrellas.

According to such a storage device of the present invention, items, such as French bread, can be wrapped by using opening means which opens the openings of the wrapping bags. A box in which a plurality of wrapping bags are stored, can be filled into the device body and, thus, a number of the wrapping bags can be easily replenished into the device's body by a simple and easy operation. In connection with this fact, because a number of wrapping bags are stored in one box, there is no danger to scatter them during storing and delivering operation, and the handling can easily be done.

According to the wrapping bags of the present invention, a number of wrapping bags can be suspended in order to be retained in the device by penetrating a bar hanger into locking holes provided at the upper edge of the projected portion. Additionally, the upper ends of the fore side of the openings are folded (e.g., in a U-shape) and, thus, a means of bag opening can be inserted into the openings of said wrapping bags in order to open such bags.

The device body for storing and dispensing the wrapping bags is not limited to the structure as a casing. It can be structured with pillars, for example. In such case the device body is comprised by pillars, and such transparent members can be arranged between the pillars.

BRIEF DESCRIPTION OF THE DRAWINGS

Preferred embodiments of the present invention are described with reference to the attached drawings in which.

DETAILED DESCRIPTION OF THE PREFERRED EMBODIMENTS

In the best mode of the present invention, an umbrella is used as an example of a long and narrow item to be wrapped.

Figure 2:
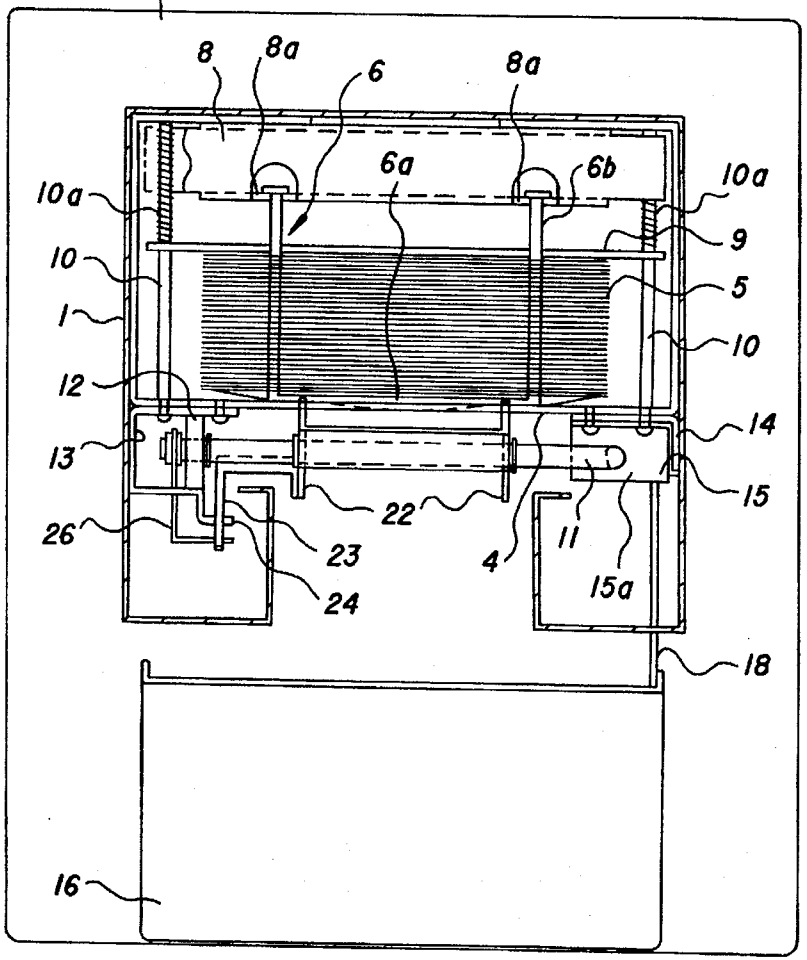
FIG. 2 is an enlarged top plan view showing the embodiment in FIG. 1 with the upper cover open.
Figure 1:
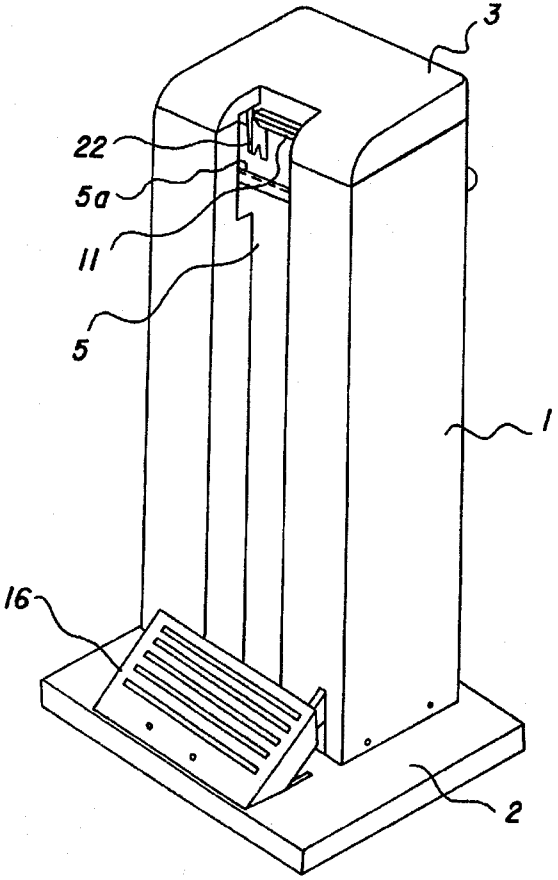
FIG. 1 is a perspective view showing a preferred embodiment of the storage device for storage bags of the present invention.
Figure 3:
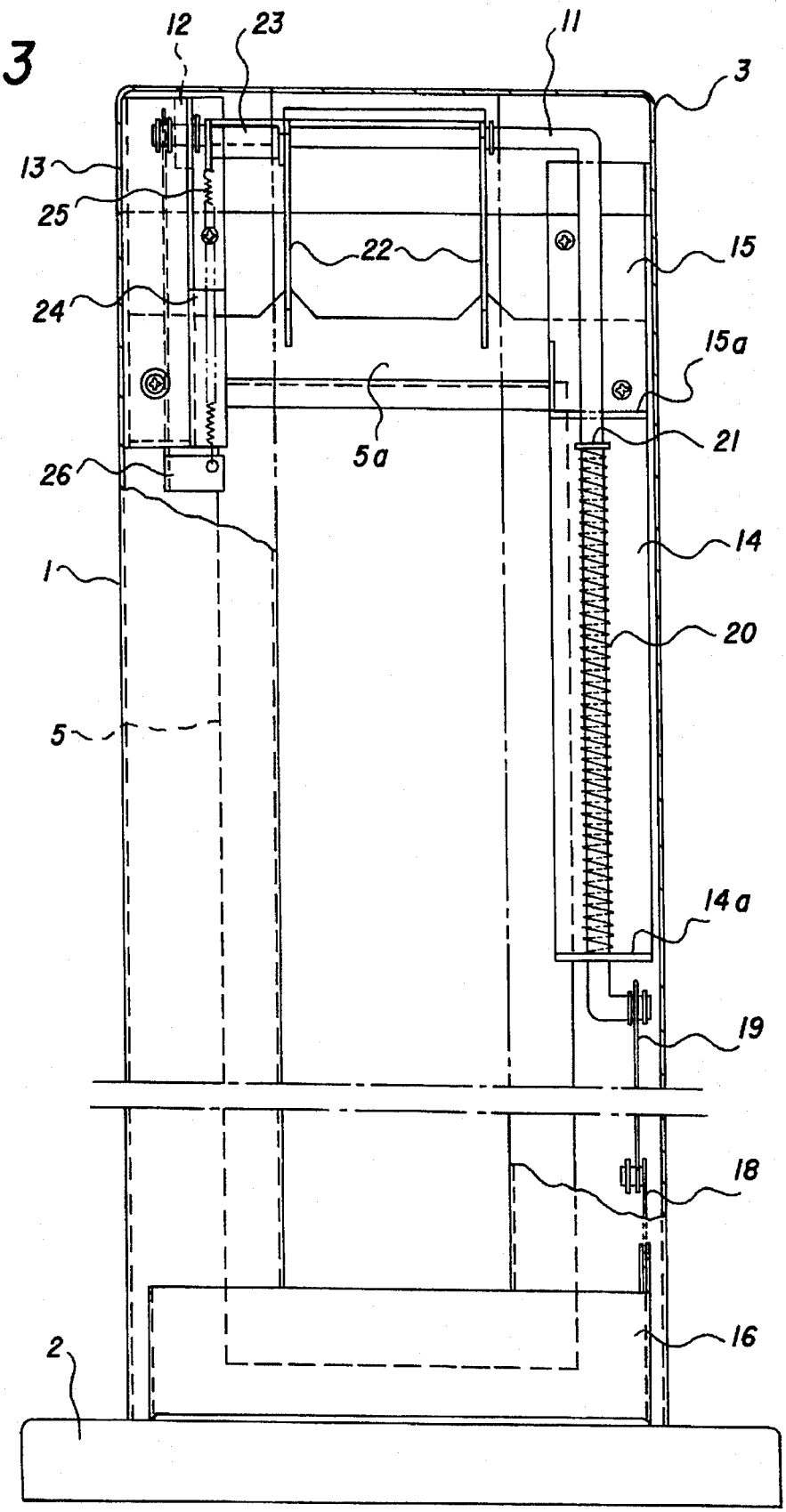
FIG. 3 is a front view of the embodiment shown in FIG. 1.
Figure 4:
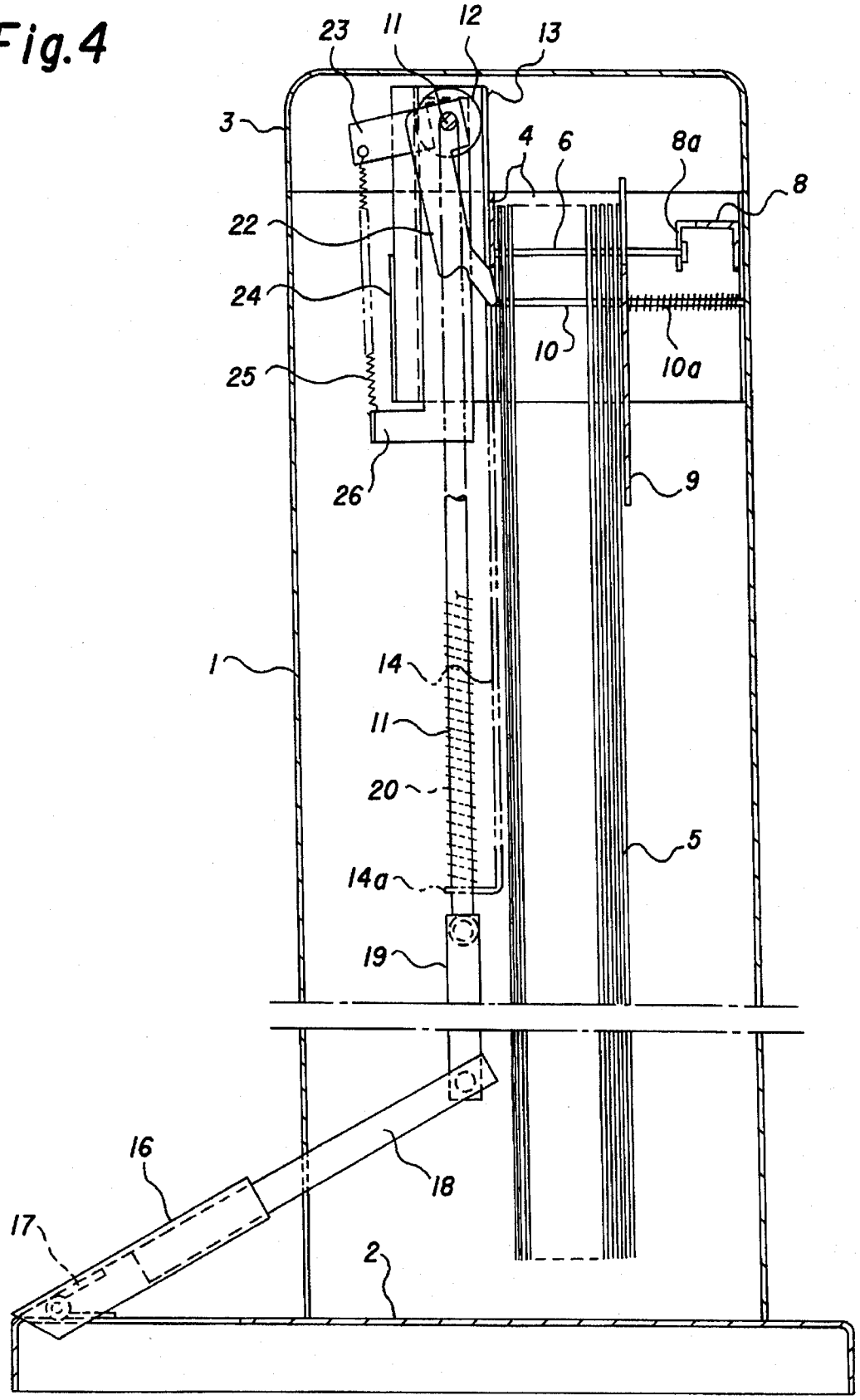
FIG. 4 is a side view of the embodiment show in FIG. 1.

In FIG. 1 to FIG. 4, the character 1 is a quadratic prism-shaped device body and the case 1 is situated on a bed plate 2 with closing cover 3 on top of the device body 1. As shown in FIG. 2 and FIG. 4, a fixed support base 4 is mounted on the upper inside of body 1; a hanger 6, suspended to store wrapping bags 5 (formed from synthetic resin film and the like), is set on the fixed support base 4.

As shown in FIG. 2, the hanger 6 is comprised of a bar formed in box type (top-open rectangle shaped); the base 6*a* is anchored to a hook (not illustrated) and mounted on the fixed support base 4. The hanger 6 is installed by hitching both ends 6*a*, 6*b* to anchor holes 8*a* of support member 8, fixed to the fixed support base 4, for easy removal.

Figure 6A:
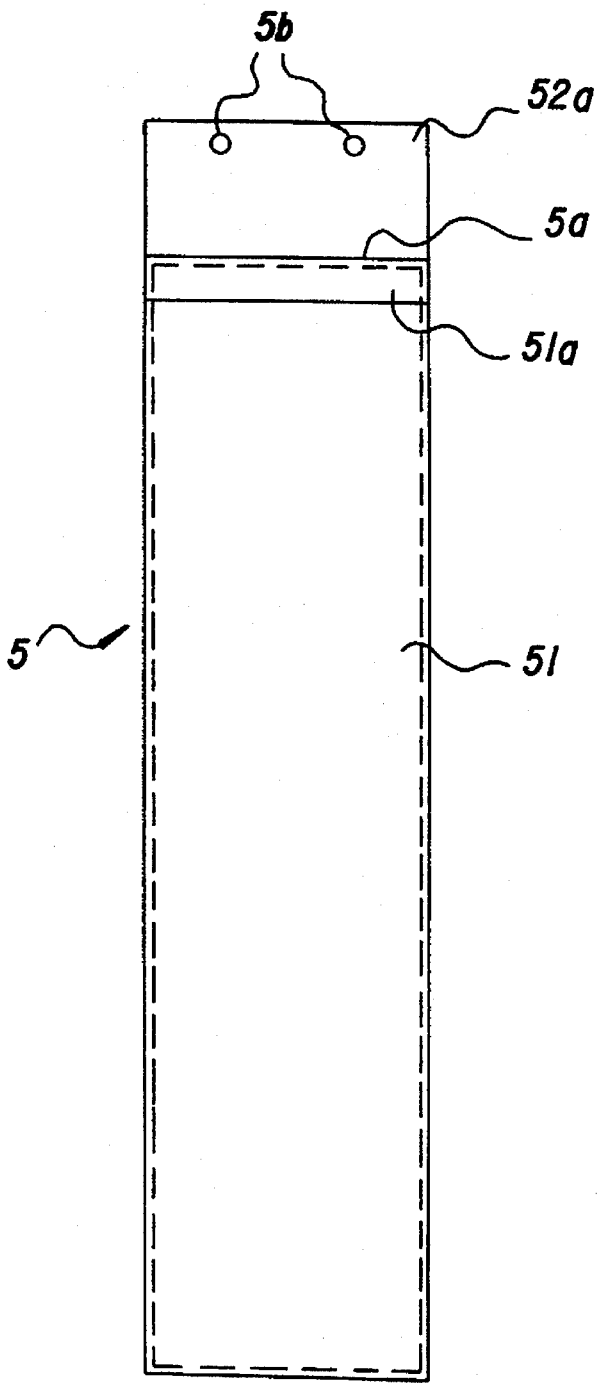
FIGS. 6(A) and 6(B) are a front view and a section view of the wrapping bag, respectively.
Figure 6B:
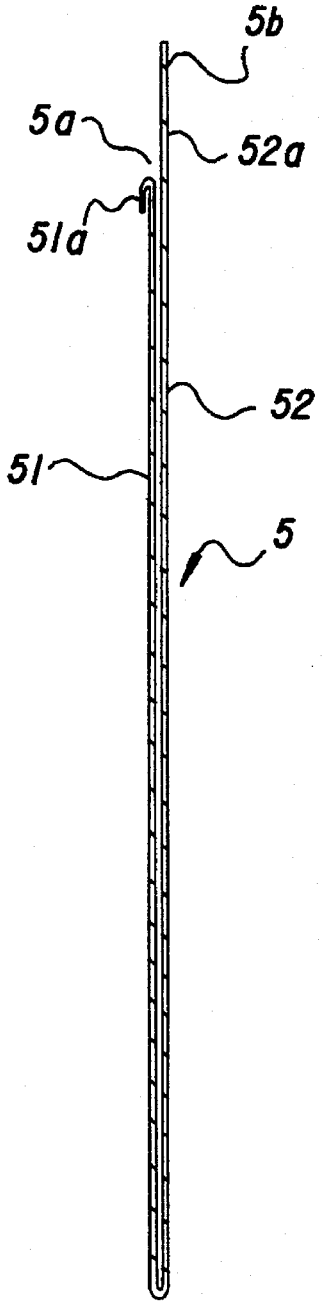

On the other hand, as shown in FIG. 6, the top of the wrapping bag 5 has an opening 5*a*; the upper end 51*a* of the fore side 51 of the opening is folded forward in U-shape; and the upper end 52*a* of the rear side 52 is projected above that of the fore side 51. A pair of locking holes 5*b* are provided at the upper end of the projected portion.

As shown in FIG. 2 and FIG. 4, a number of wrapping bags are suspended for storage by inserting the opposing member 6*b* into each locking hole 5*b* of the wrapping bags.

A movable pressure plate 9 is along the guide bar 10, 10 on the rear face of the wrapping bags 5 and the pressure plate 9 is constantly pressed against the rear face of the wrapping bags 5 by a coil spring 10*a* on each guide bar.

Figure 5:
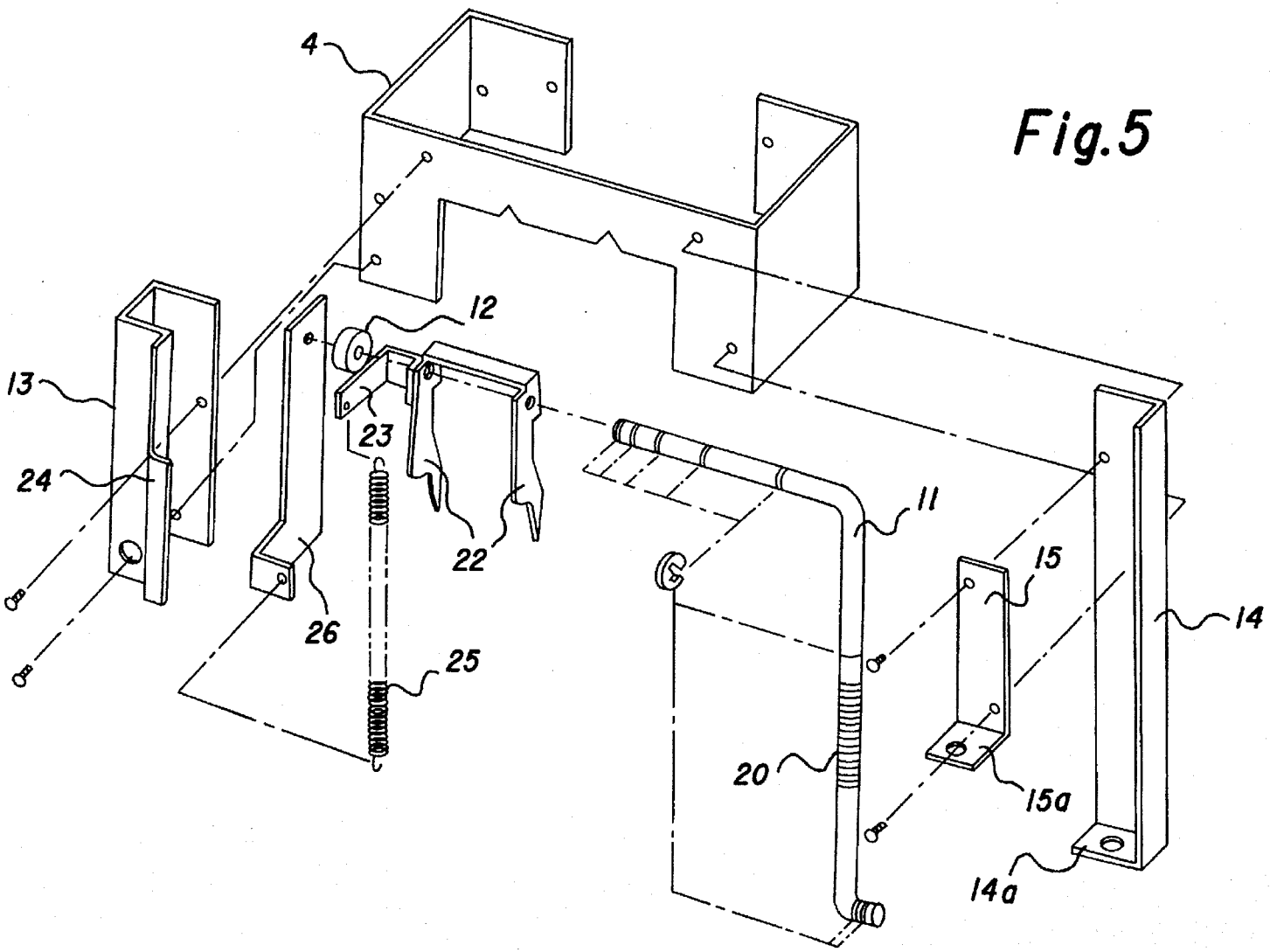
FIG. 5 is an exploded perspective view of the upper portion of the device.

As shown in FIG. 3 and FIG. 5, guide members 14, 15 are mounted ahead of fixed support base 4. A movable support member 11, in an inverted L-shape, from the front view, is penetrated for storage and to move vertically in holes 14*b*, 15*b* formed on horizontal arms 14*a*, 15*a* of such guide members. Besides, a roller 12 is provided at the upper end of the movable support member 11 and can rotate freely; the roller 12 is arranged along with a box type guide rail 13 and then mounted ahead of the fixed support base 4 to move vertically.

A foot pedal 16 is provided on bed plate 2 to lower the movable support member 11. As shown in FIG. 4, the foot pedal 16 is mounted or installed with a hinge 17 to move vertically on the bed plate 2. A lever 18 is integrally mounted to the pedal 16 and the lever 18 is connected to the lower end of the movable support member 11 through a link 19.

In FIG. 4, return spring 20 returns movable support member 11. The return spring 20 is arranged between a spring bearing 21, FIG. 3, comprising of a clip or the like, mounted to a movable support member 11 and a horizontal arm 14*a* of the guide member 14 under contracted conditions.

In addition, a pair of open control levers 22, 22, FIGS. 4 and 5, are horizontally provided on the upper central position of movable support member 11 to rotate in order to open the openings 5*a* by entering into the openings 5*a* of the wrapping bags. Both ends of levers 22, 22 are integrally connected in the bottom-open rectangle-shape in the illustrated example.

A moving control arm 23, FIGS. 4 and 5, is integrally provided on one end of levers 22, 22 to rotate the levers 22, 22. A contacting plate 24 is provided under the arm 23 integral to guide rail 13. Contacting plate 24 actuates to rotate both levers 22, 22 clockwise in FIG. 4 by contacting with arm 23.

Coil spring 25 is set as a tension coil spring between moving control arm 23 and spring bearing 26 connected vertically to one end of the movable support member 11, and allowed to rotate freely and makes the lower end of open control levers 22, 22 move and rotate constantly in the direction of the wrapping bags 5. The lower end of the open control lever 22 can be moved to rotate in the direction of the wrapping bags 5 by locking one end of a helical spring to the movable support member 11 and the other end of the spring to control lever 22; in this case, the helical spring, and the like, can be arranged around the movable support member 11 close to control lever 22.

Figures 7A, 7B, 7C:
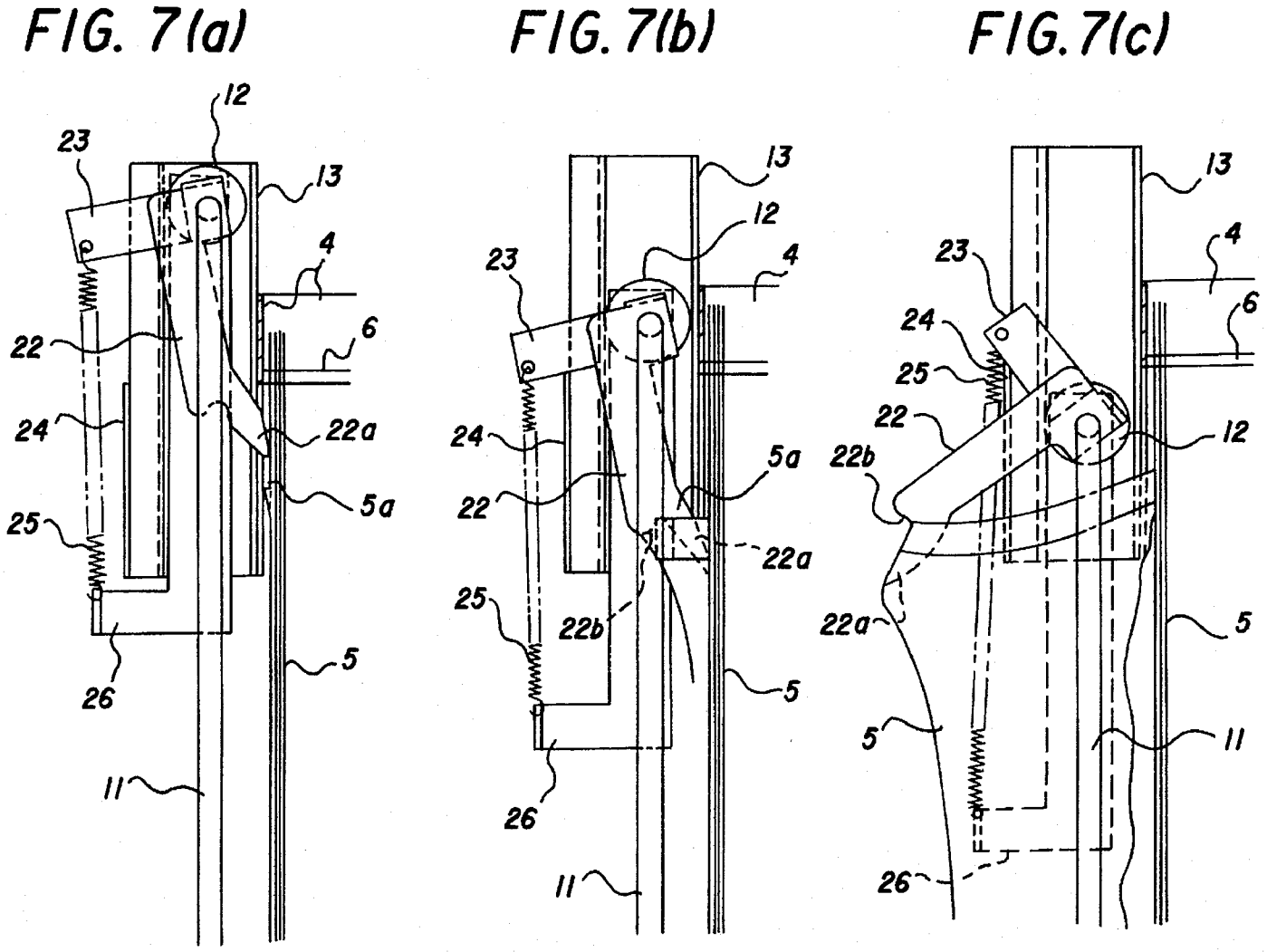
FIGS. 7(A), 7(B) and 7(C) are explanatory drawings of storing operation.

According to the aforementioned structure, as conventionally shown in FIG. 7A, the movable support member 11, and the pedal 16 are pushed up by the return spring 20 to the ascending position shown in FIG. 3 and FIG. 4. As a result, the lower ends of the open control levers 22, 22 are placed above that of the openings 5*a* of the wrapping bags 5.

When the pedal 16 is pushed by the foot in the same state as mentioned above, the movable support member 11 is lowered against the return spring 20. And then, as shown in FIG. 7B, the end 22*a* of the open control lever 22 enters into the opening 5*a* of the wrapping bag 5; in this case, as illustrated, the end 22*a* of lever 22 can enter accurately into the opening 5*a* when the upper end 51*a* of 51 of the opening 5*a* is folded.

Should the end 22*a* of open control lever 22 be entered into opening 5*a* up to a specified depth, as shown in FIG. 7B, the aforementioned moving control arm 23 will contact with the upper end of the contacting plate 24. In the same manner, should the open control lever 22 continuously move lower together with the movable support member 11, each open control lever 22, 22 rotates in clockwise direction against the rotating spring 25 around a fulcrum at a contacting point of contacting plate 24 in order to open the opening 5*a* of the wrapping bag 5, FIG. 7C.

In addition, in the event that a concave 22*b* [see FIG. 7C] is formed close to the end of the open control lever 22, to enter the upper part 51*a* of the wrapping bag 5 into such a concavity 22*b*, the upper part 51*a* can be removed from lever 22 to avoid the rotating open control lever 22.

When the opening 5*a* of the wrapping bag 5 is open, an article to be wrapped, such as an umbrella can be inserted into wrapping bag 5 from between the open control levers 22, 22 in order to wrap and store the article.

The bag 5 in which an article, such as an umbrella, is wrapped can then be removed from the hanger 6 tearing the upper locking holes 5*b* of the wrapping bag 5 by pulling the bag out from the front of the device body 1. Thus, the bag wrapping an umbrella can easily be taken out from the device body 1.

When a foot is released from the foot pedal 16, after an umbrella wrapped in wrapping bag is taken out, the movable support member 11 and the pedal 16 will return by the return spring 20 to the state shown in FIG. 3 and FIG. 4. Simultaneously, the open control lever 22 will return by the rotating spring 25 to the state shown in FIG. 7A to a standby state.

As mentioned above, according to the embodiment shown in FIG. 1 to FIG. 7, articles such as umbrellas, can be easily wrapped in each wrapping bag accurately without using a motor or a vacuum pump, and the like, in order to open the openings of wrapping bags easily and completely.

The other embodiment is explained as follows referring to FIG. 8 to FIG. 12. According to the embodiment shown in FIG. 8 to FIG. 12, a number of wrapping bags 104 are first stored in a box 105; and the box in which a number of wrapping bags are stored is charged in a device body 101.

Figure 8A:
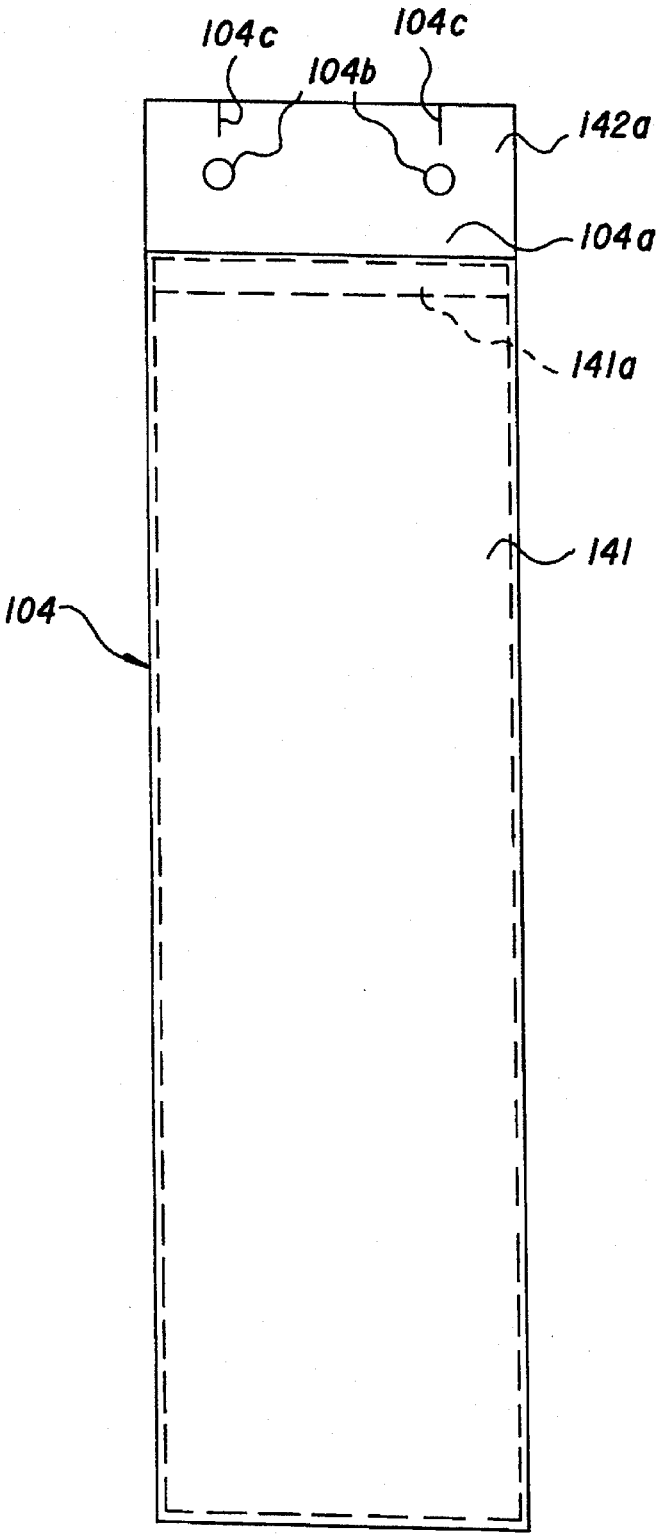
FIGS. 8(A) and 8(B) are a front view and a section view of the wrapping bag, respectively.
Figure 8B:
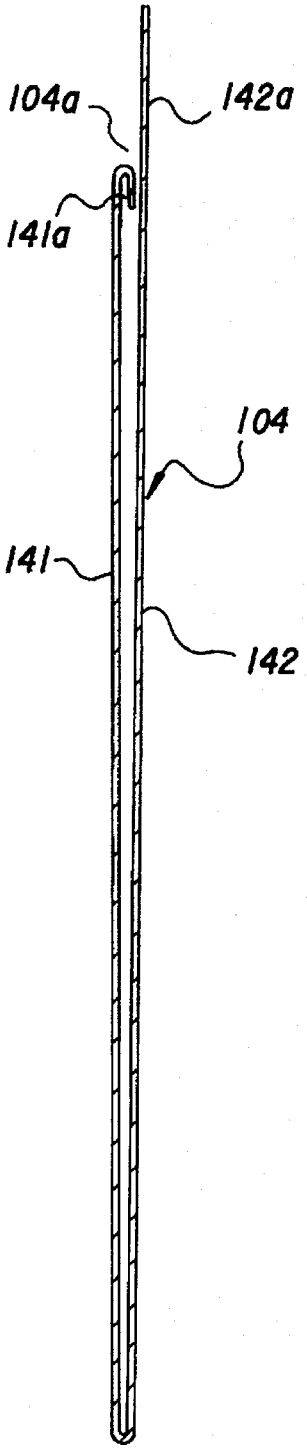

A wrapping bag used in the embodiment shown in FIG. 8 to FIG. 12 is shown in FIGS. 8A and 8B. The wrapping bag 104 comprises of a plastic film and the like, and as shown in FIG. 8, is formed in flat cylinder-shape; the upper part of the wrapping bag has an opening 4*a;* the upper end 141*a* of the fore side 141 of the opening 104*a* is folded in U-shape toward the rear side 142; and the upper end 142*a* of the rear side 142 is projected above the fore side 141. A pair of locking holes 104*b* are provided at the upper end 142*a*.

Figure 9:
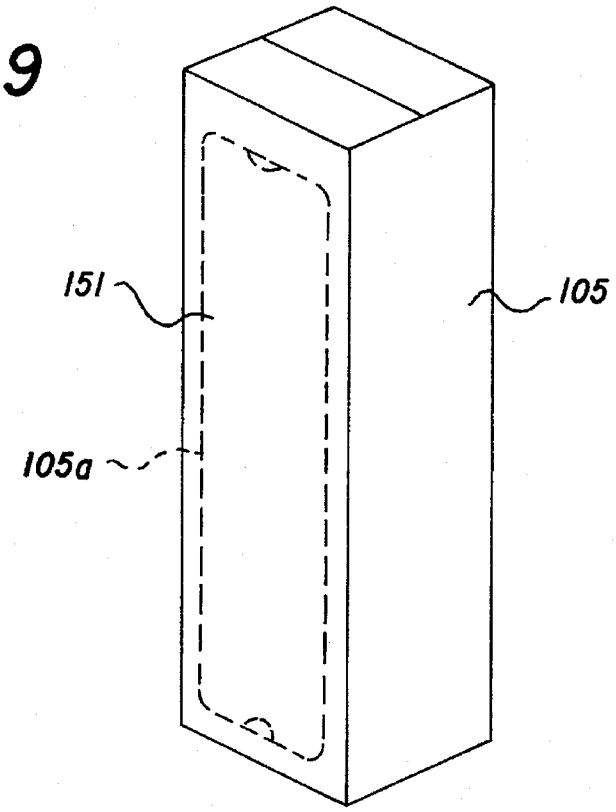
FIG. 9 is a perspective view of the storage container.
Figure 10:
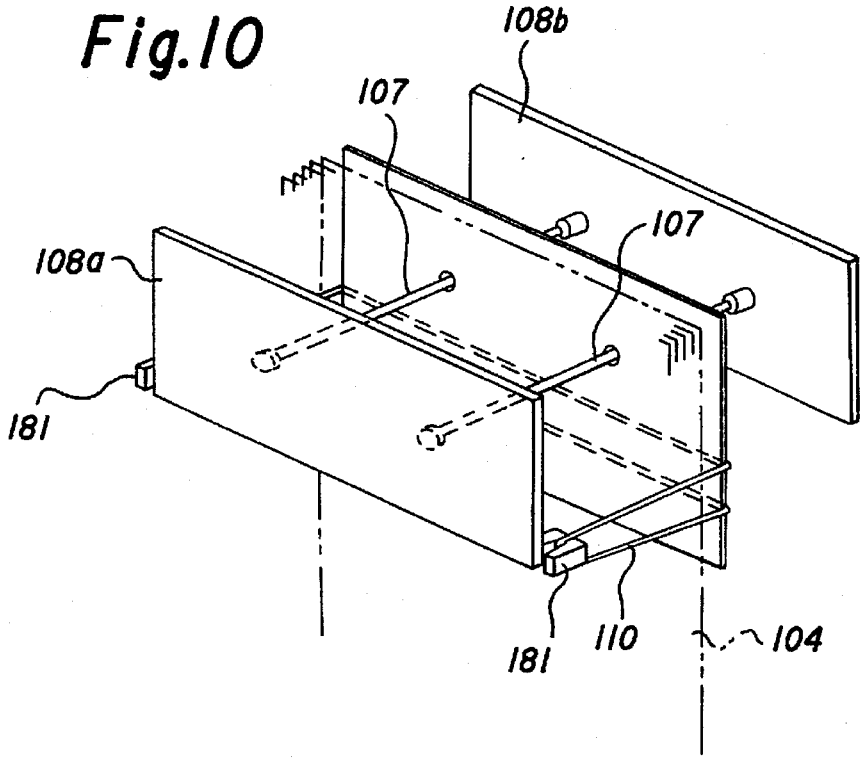
FIG. 10 is a perspective view of the member suspending the wrapping bags in order to store them in a box.

The aforementioned box 105 is made of corrugated fiberboard. As shown in FIG. 9, it is formed in a shape of longitudinal rectangular parallel pipe. A shown in FIG. 10, a pair of bar-shaped hangers 107, 107 are provided on the inside of the upper part of the box 105 and the hangers 107, 107 are penetrated into locking holes 104*b* of the wrapping bag 104. And then, the hanger 107 is installed to support plates 108*a*, 108*b* fixed to the upper surface inside the box 105. Thus, a number of wrapping bags 104 can be suspended to retain a state that the fore side 141 faces the left-hand side, as shown in FIG. 10.

Figure 12:
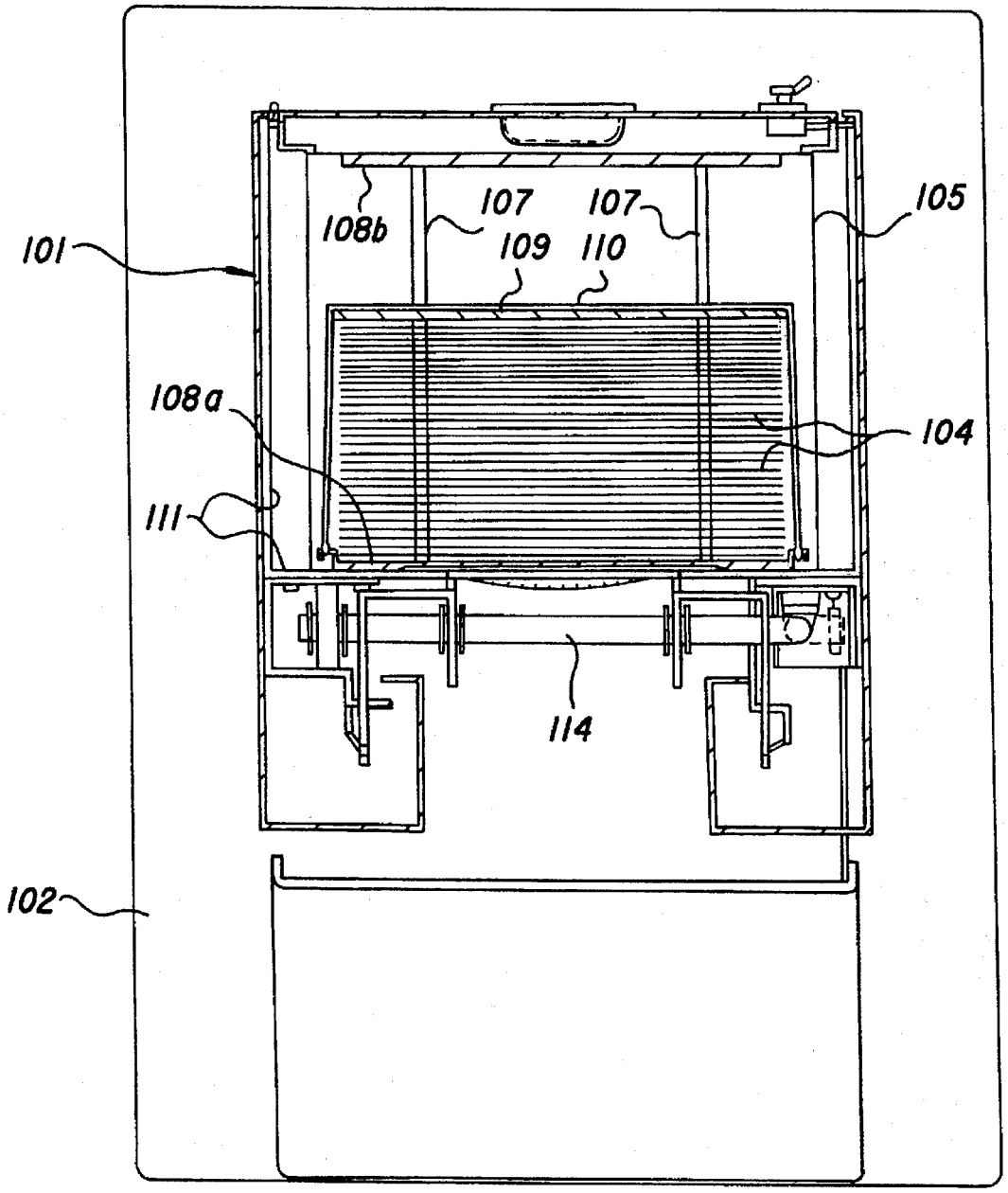
FIG. 12 is a top view with the top removed of a device body shown in FIG. 11.

A pressure plate, FIG. 12, is arranged on rear face of wrapping bags 104. The pressure plate presses the wrapping bags with an elastic member. In FIG. 10, rubber bands 110 are applied as the elastic members; both ends of the rubber bands 110 are anchored to a hook 181 provided at both sides of the supporting plate 108*a*.

Figure 11:
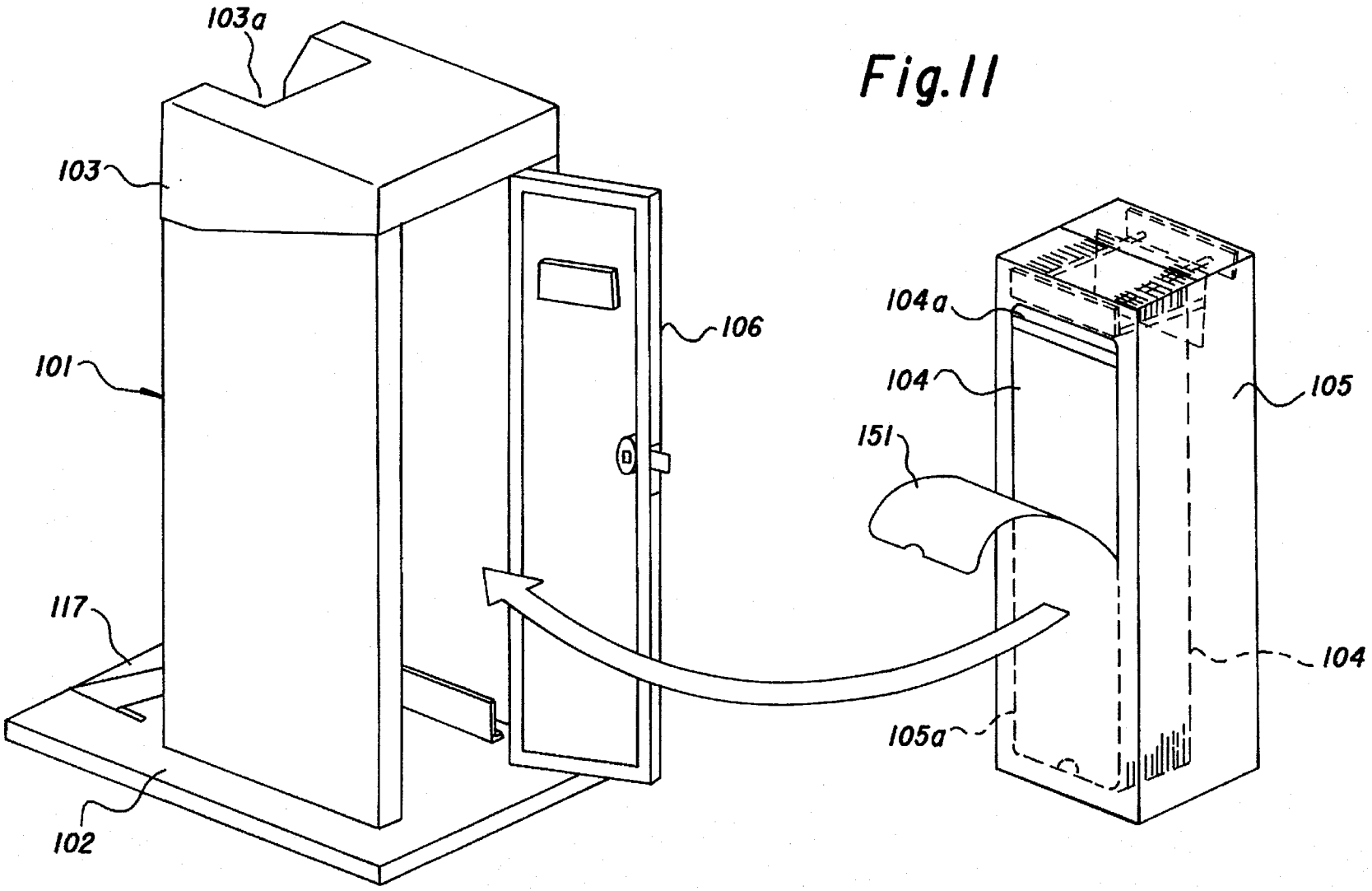
FIG. 11 is a perspective view showing the state of a box charging in the storage device of the present invention.

As shown in FIG. 9, an opening 151, which can open along with perforating scores 105*a*, is provided on the front face of the box 105. Box 105, or the wrapping bags 104 that are stored in the box, are transferred and stored without opening 51 when they are not used. When they are used, as shown in FIG. 11, after the opening 151 is open along with the perforating scores 105*a*, open a switch door 106 provided on the rear side of the device body 101 to place the box 105 into the device body 1 while opening the opening 151.

As shown in FIG. 12, a box type fixed support member is integrally provided inside the device body 101 on the upper part of the box 105 placed in the device body. The positioning is done to contact the fore side of the fixed support member 111 with the front face of box 105.

Figure 13:
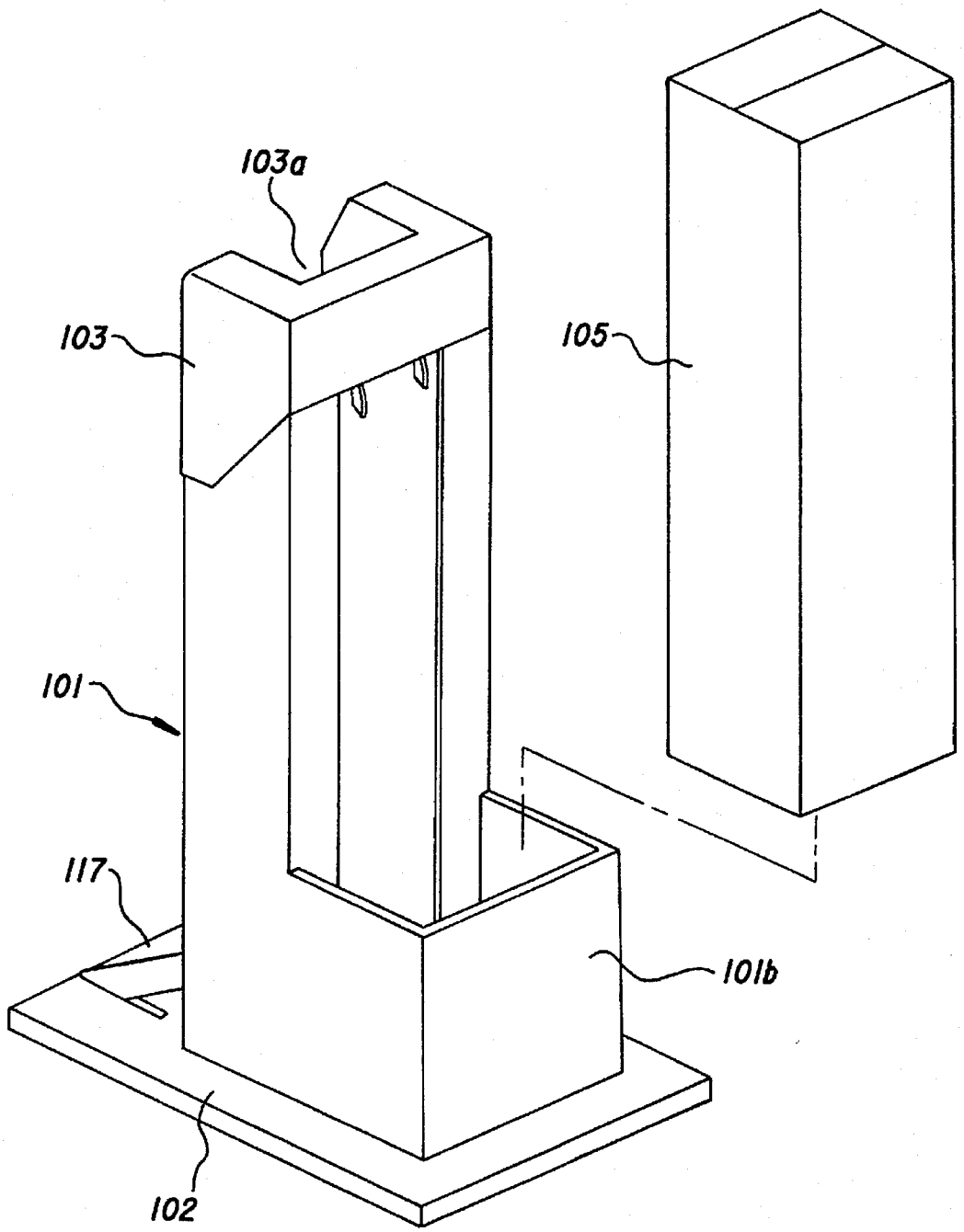
FIG. 13 is a perspective view of another embodiment of the invention.

According to the aforementioned embodiment shown in FIG. 8 to FIG. 12, the box 105 storing wrapping bags for umbrellas, or similar articles, is charged from the rear side to the device body 101. However, the box can be charged from the top of the device body 101 by configuring, for example, a cover 103 to open. In addition, as shown in FIG. 13, a frame body 101*b* can be applied as a part of the device body to place the box 105 into the frame 101*b* to determine the specified position to retain the box without covering up all faces of the box 105 by the device body 101. Besides, the opening 4*a* of the wrapping bag 4 can be opened by actuating a vacuum suction in the aforementioned prior embodiment without using the open control lever 22 to open the opening 4*a* in accordance with the embodiment shown in FIG. 1 to FIG. 7.

Figure 14:
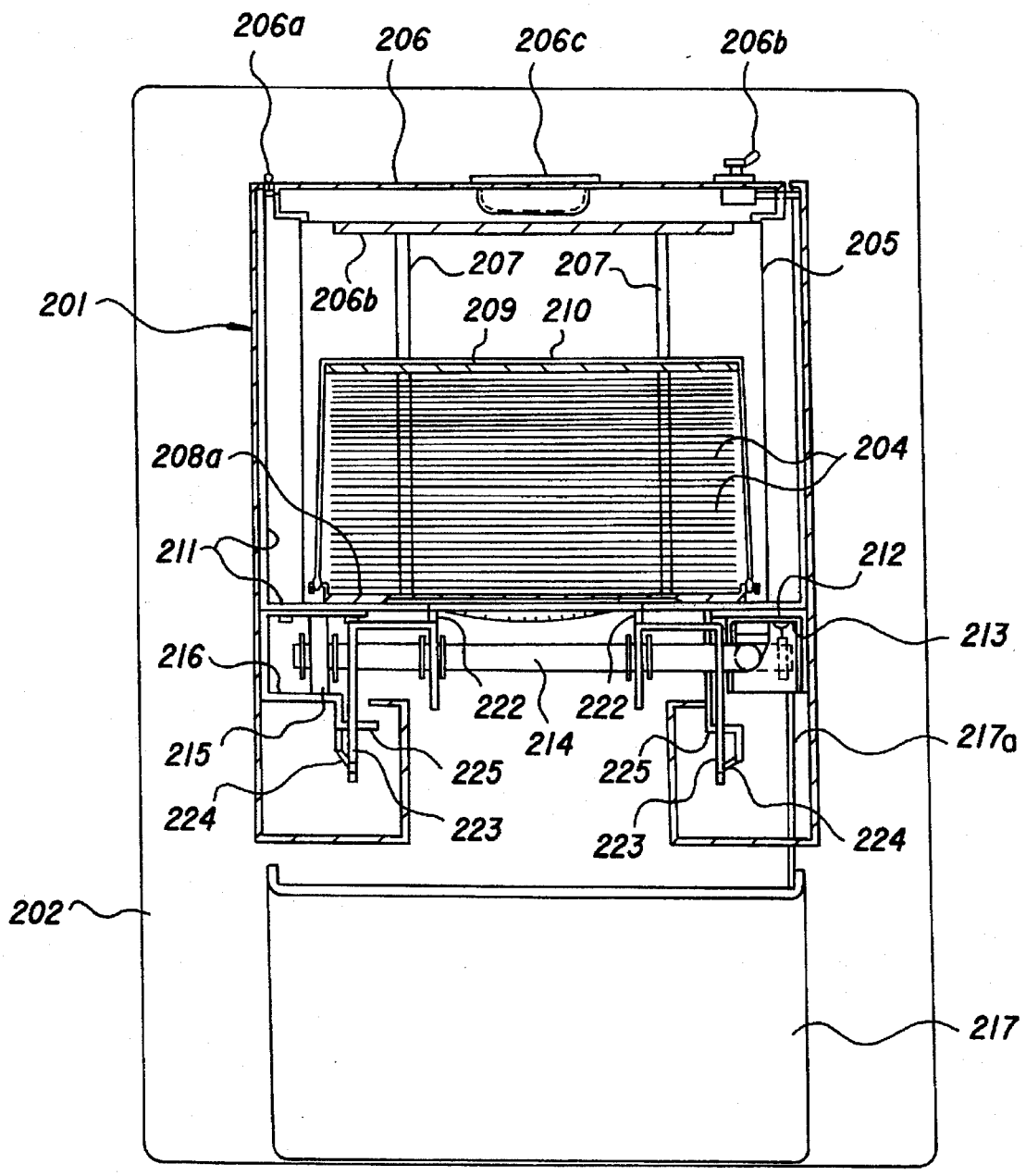
FIG. 14 is a top view of another embodiment of the present invention.
Figure 15:
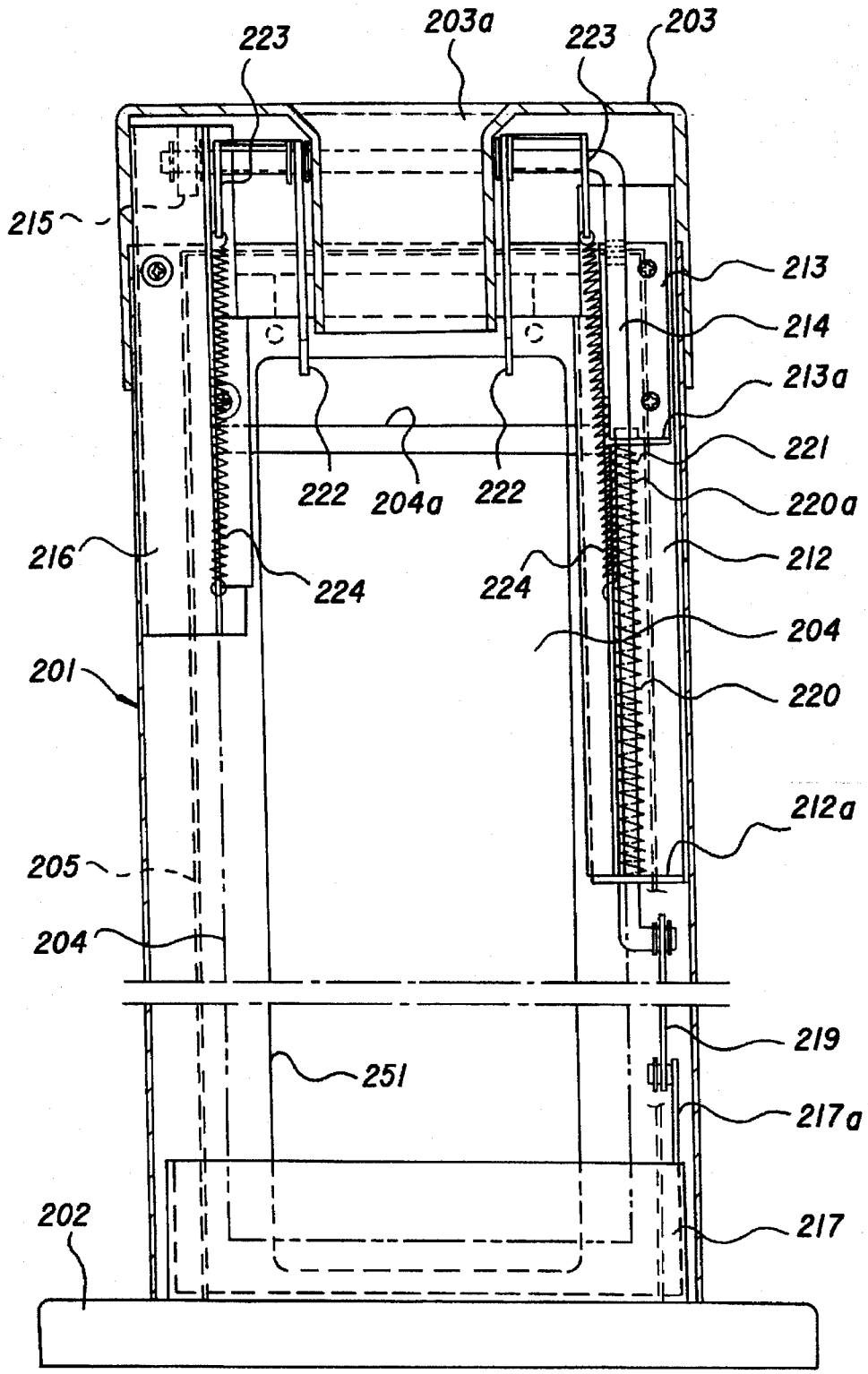
FIG. 15 is a front view, partly in section, of the embodiment shown in FIG. 14.
Figure 16:
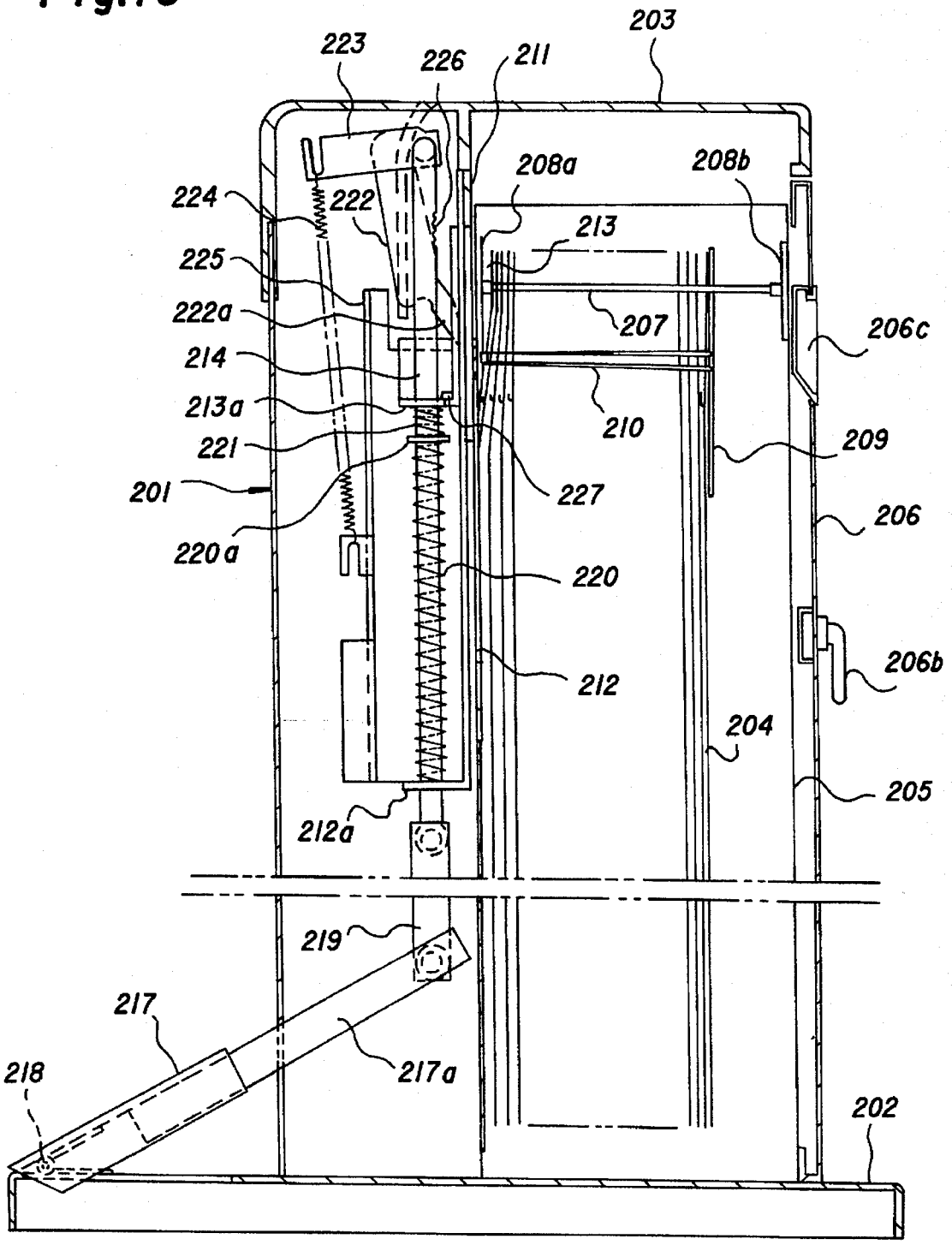
FIG. 16 is a side view, partly in section, of the embodiment of FIG. 13 and FIG. 14.

The following explains the other embodiment in the present invention referring to FIG. 14 to FIG. 16. According to this embodiment, a pair of horizontal open control levers are structured to move and rotate independently.

In FIG. 14 and FIG. 15, a left-hand side tension coil spring 224 is applied between a left-hand side rotation control arm 223 and guide rail 216. A right-hand side tension coil spring is applied between a right-hand side rotation control arm 223 and guide member 212. And as shown in FIG. 14 and FIG. 16, contacting plates 225, 255 are integrally provided on the guide rail 216 and guide member 212; the contacting plates allow each open control lever 222 to rotate in the reverse direction toward a wrapping bag 4 by contacting with the rotating control arm 223 when each open control lever 222 moves lower together with a movable support member 214.

Tension coil spring is exemplified as means of making each open control lever 222, 222 rotate toward wrapping bags 204. However, for example, a helical spring can be applied as the means, as well.

With regard to a mechanism to open wrapping bags 204, redundant explanations on such a structure are skipped since the explanation according to FIG. 7 is almost the same. According to the embodiment shown in FIG. 14 to FIG. 16, when a foot pedal 217 is depressed and the movable support member 214 lowers against a return spring 220, through a link 219, each open control lever 222 separately moves and rotates independently to the movable support member 214. Simultaneously, since springs 224, which move and rotate in the direction to press the open control levers 222, 222 toward the wrapping bags, are separately applied horizontally, each open control lever 222 can be inserted into the opening 204*a* by lowering in a good state of contacting with the front face of the upper rear end 242*a* of the forefront wrapping bag 204 even some longitudinal misregistration of the opening 204*a* in the cross direction to the forefront of the wrapping bag 204 is generated.

In the aforementioned embodiment, the foot pedal is continuously depressed until an umbrella stored in a wrapping bag is removed from the device body; when the foot pedal is released, after the wrapping bag is taken out, the original condition will return through the use of a return spring that ascends to the movable support member.

In addition, it can be structured such that the forefront wrapping bag is maintains the opening by applying anchoring as a means to keep lowering the movable support member by pressing the foot pedal until the wrapped umbrella is taken out when the foot pedal is released. For example, as shown in FIG. 16, a plurality of locking grooves 226 can be formed on the movable support member 214 and an anchoring claw 227 which hitches to the grooves, can be applied integrally to the guide member 213.

Figure 17:
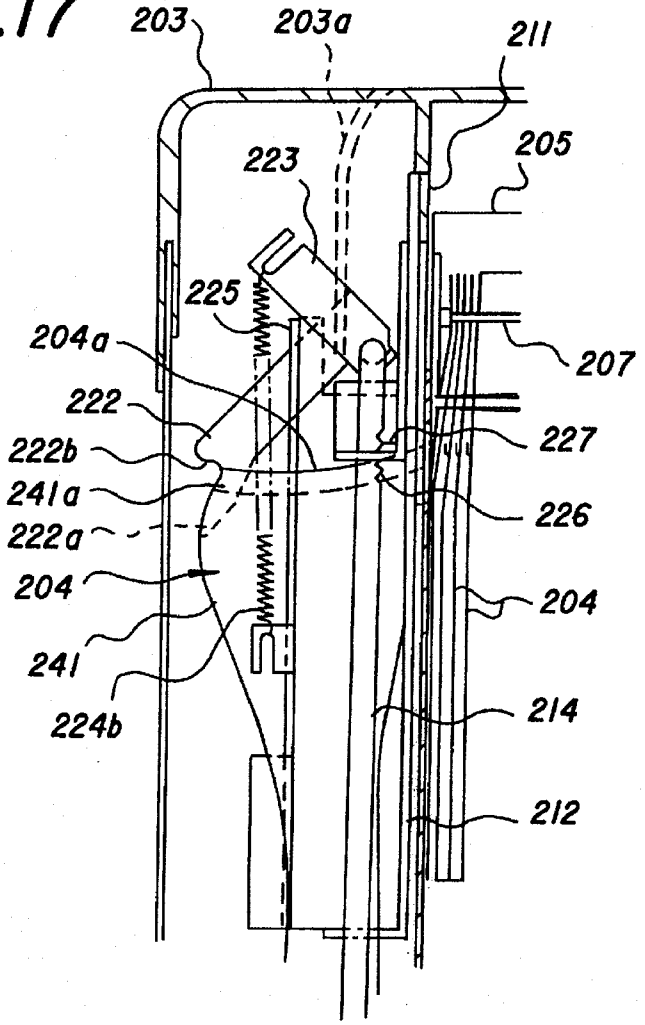
FIG. 17 is a partial side view showing a state of anchoring.

In this structure, when a foot pedal 217 is depressed to lower the movable support member 214, a locking groove 214*a*, formed on the movable support member 214, will hitch to the anchoring claw 227 as inclining the movable support member 214 to the anchoring claw 227. As a result, the opening 204*a* of the wrapping bag 204 is kept open by blocking the ascending motion of the movable support member 14 by the return spring 20 [FIG. 17].

When an umbrella, wrapped in a wrapping bag 204 opens, the opening 204*a* and the umbrella is removed from the device body, the movable support member 214 will incline in the direction to release anchoring to the anchoring claw 227 through the open control lever 222. Next, the anchoring, at locking groove 214*a* to the anchoring claw 227, is released and the movable support member 214 automatically returns to its original position for ascending by elastic rebound of the return spring 220.

Figure 18A:
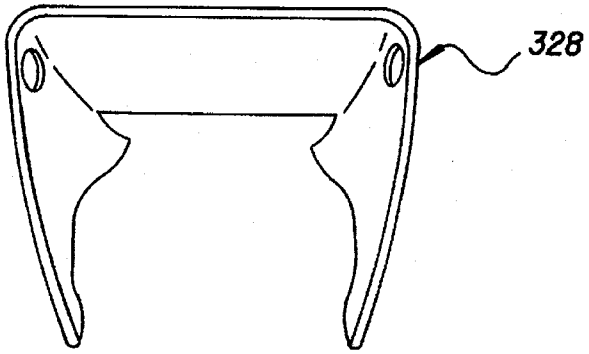
FIGS. 18(A) and 18(B) are a plan view and a side view of a bucket-shaped member, respectively, for use in the instant invention.
Figure 18B:
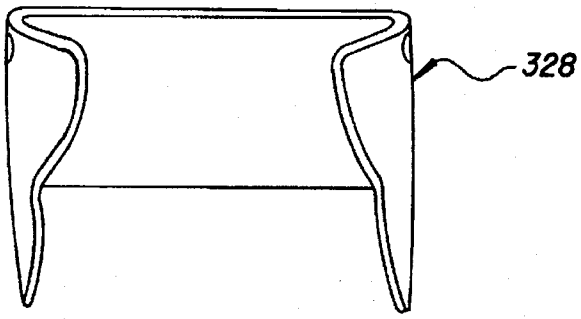
Figure 19:
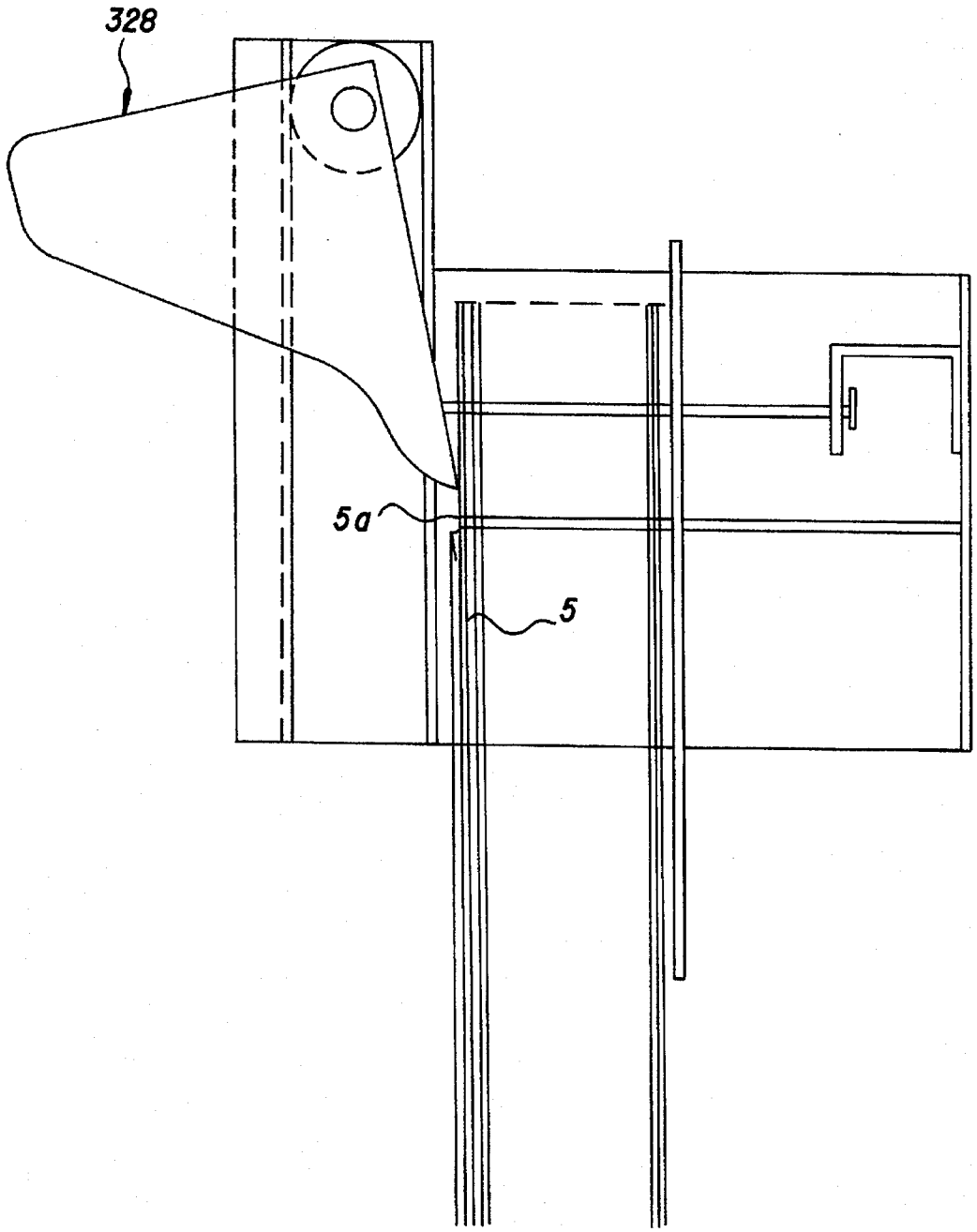
FIGS. 19 and FIG. 20 are explanatory views showing different phases of the storing operation.
Figure 20:
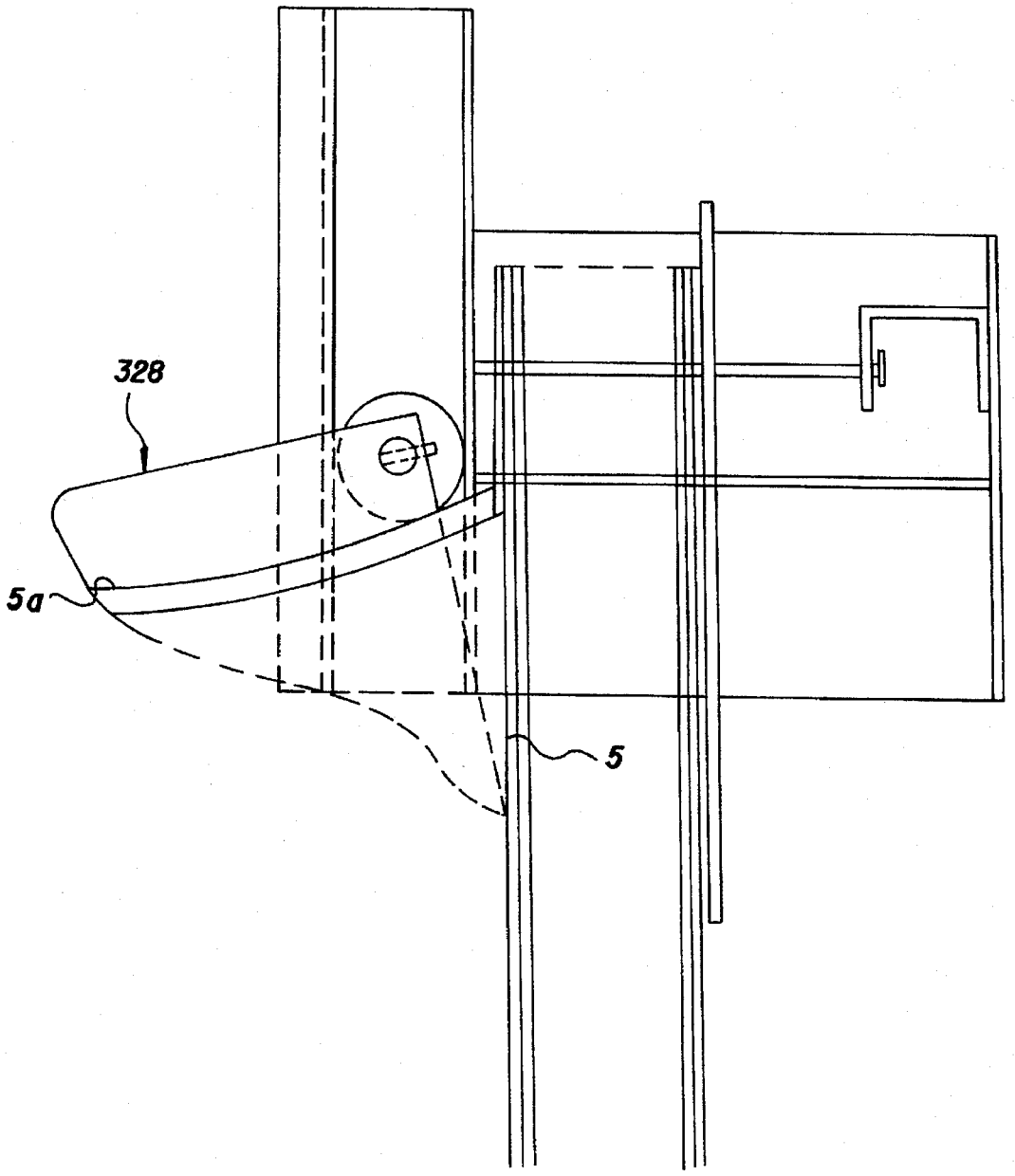
Figure 21:
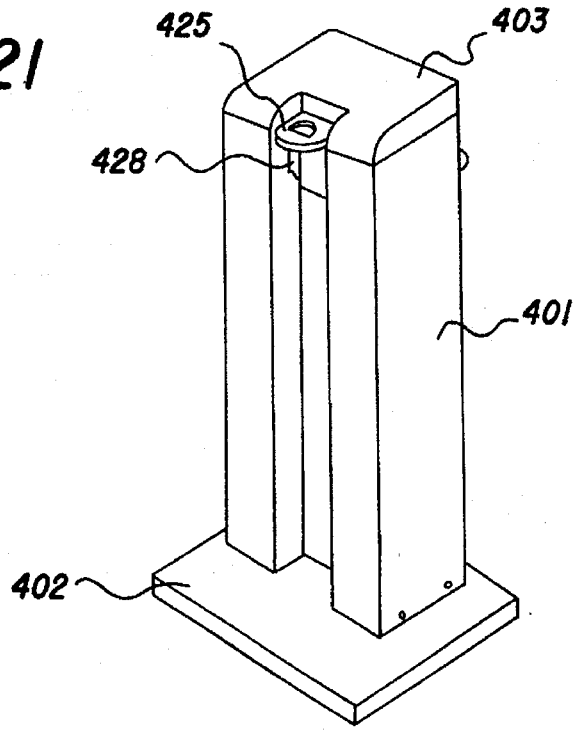
FIG. 21 is a perspective view of another embodiment.

FIG. 18 to FIG. 20 show the other embodiment of the present invention. In FIG. 18A and 18B, sign 328 shows a bucket-shaped member integrally formed from plastic. Umbrella insertion can be done easily and completely thanks to the shape of this bucket-shaped member 328. Open wrapping bags 5 with the bucket-shaped member 328 are shown in FIG. 19 and FIG. 20. However, a detailed explanation is not necessary because the state shown in FIG. 19 and FIG. 20 is similar to that in FIGS. 7A to 7C.

The following explains the other embodiment in the present invention referring to FIG. 21 to FIG. 27.

The opening operation of wrapping bags is done using a foot pedal in the embodiment shown in FIG. 1 to FIG. 20. In the embodiment shown in FIG. 21 to FIG. 27, the openings of the bags are opened without using a foot pedal.

Figure 22:
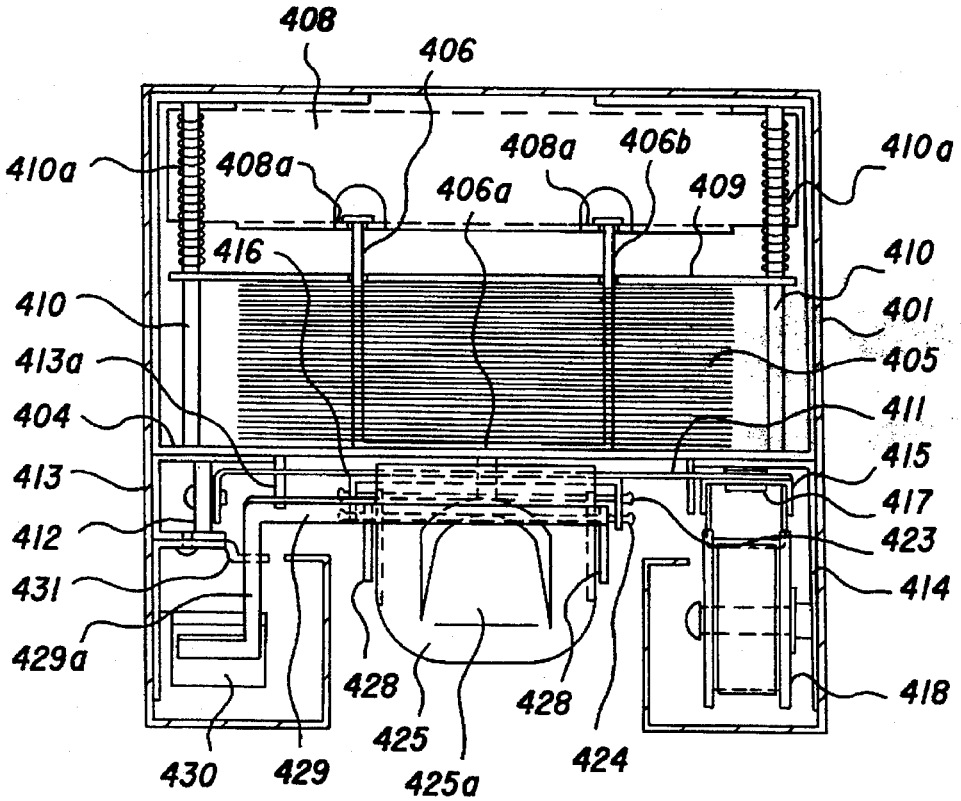
FIG. 22 is a top plan view showing a state of opening the upper cover in the embodiment of FIG. 21.
Figure 23:
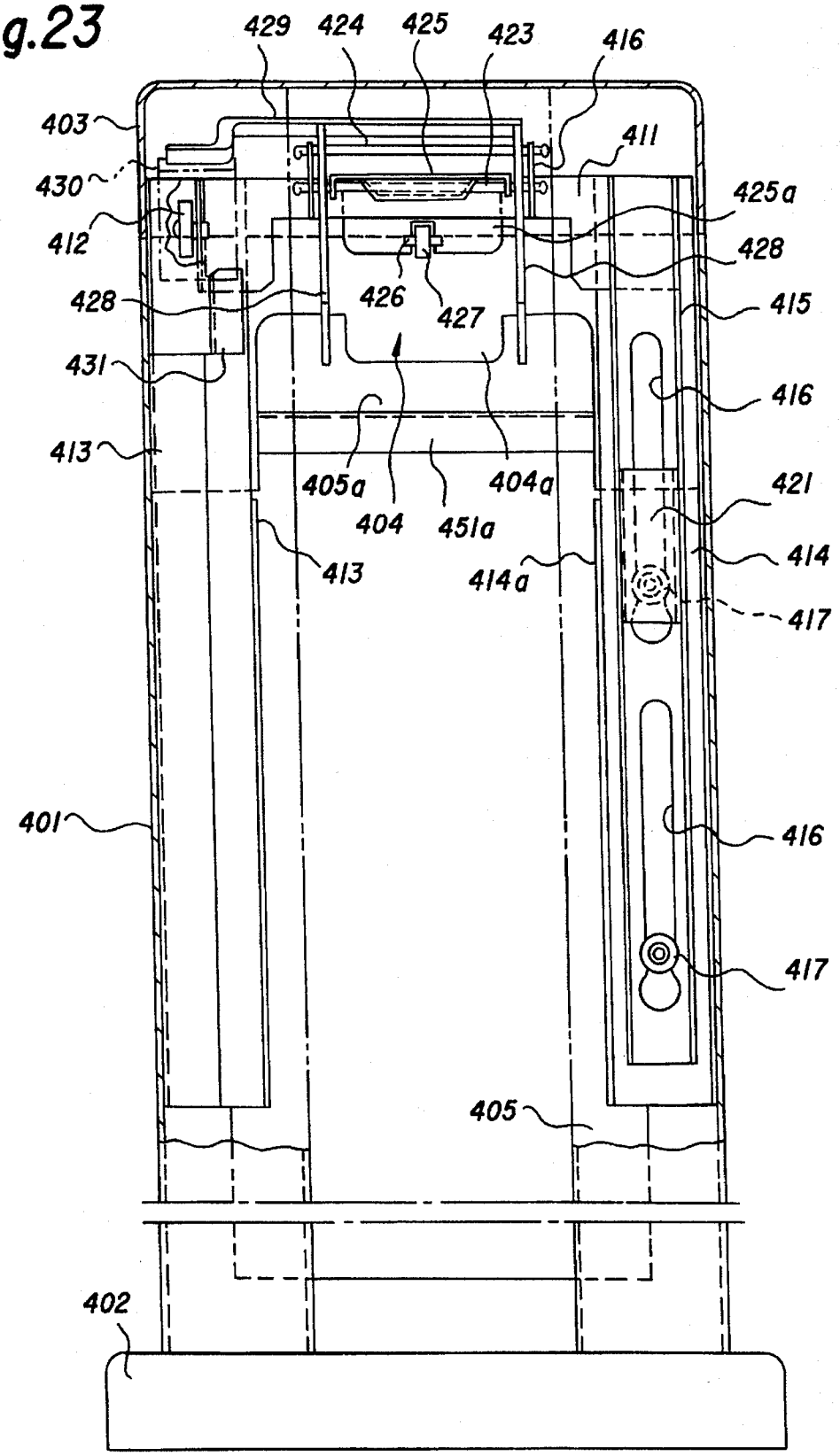
FIG. 23 is a front view, partly in section, of the embodiment shown in FIG. 21.
Figure 24:
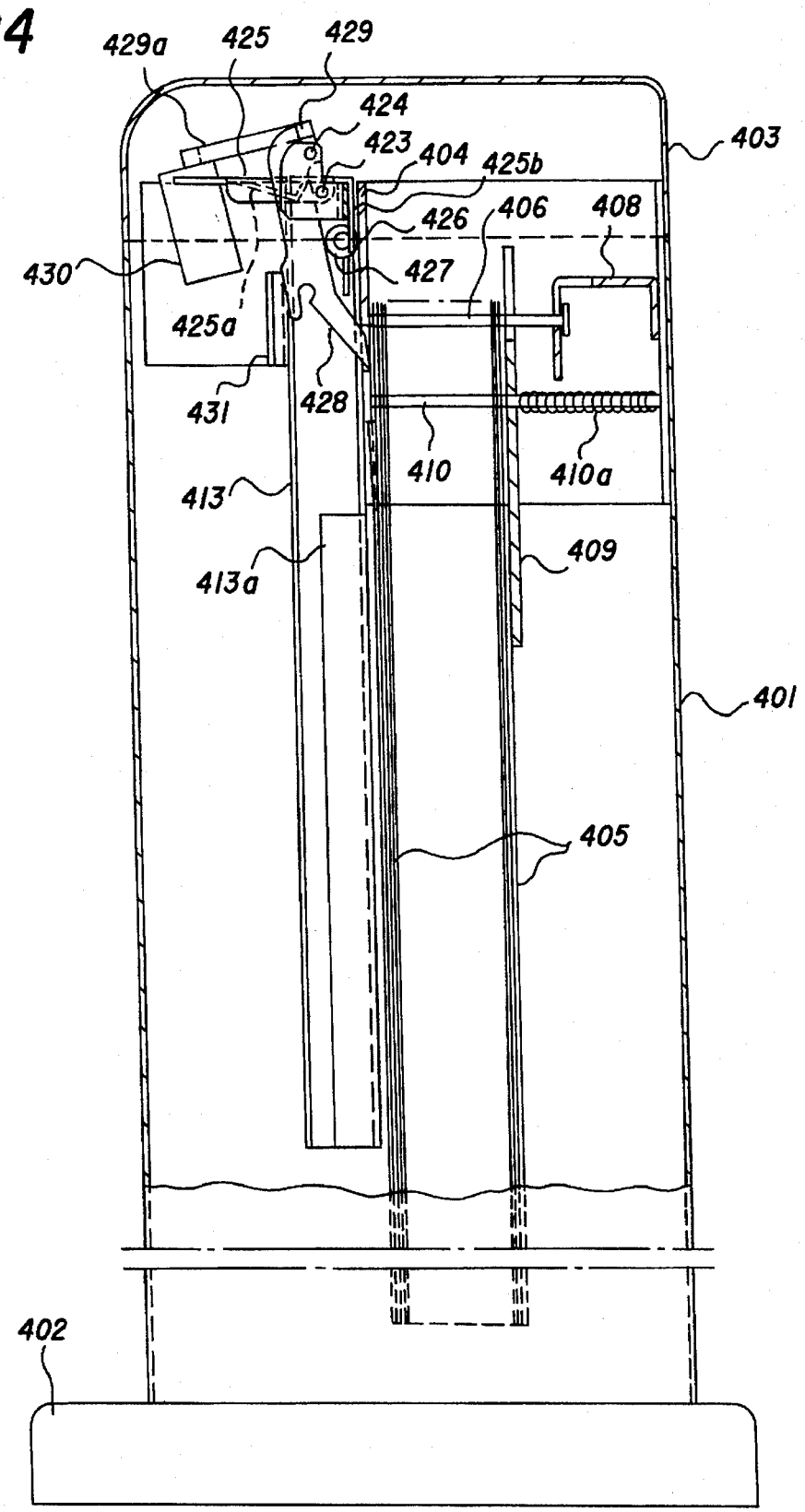
FIG. 24 is a side view of the embodiment shown in FIG. 21.

In FIG. 21 to FIG. 27, 401 is a quadratic prism-shaped device body, of which the front, central part is open, situated on a bed plate 402. The closing cover 403 is installed on top of the device body 401. As shown in FIG. 22 and FIG. 24, a fixed support base 404 is mounted on the inside of the upper device body 401; and a hanger 406, which suspends to store wrapping bags 405 formed from plastic film and the like, is set on the fixed support base 404.

Figure 25:
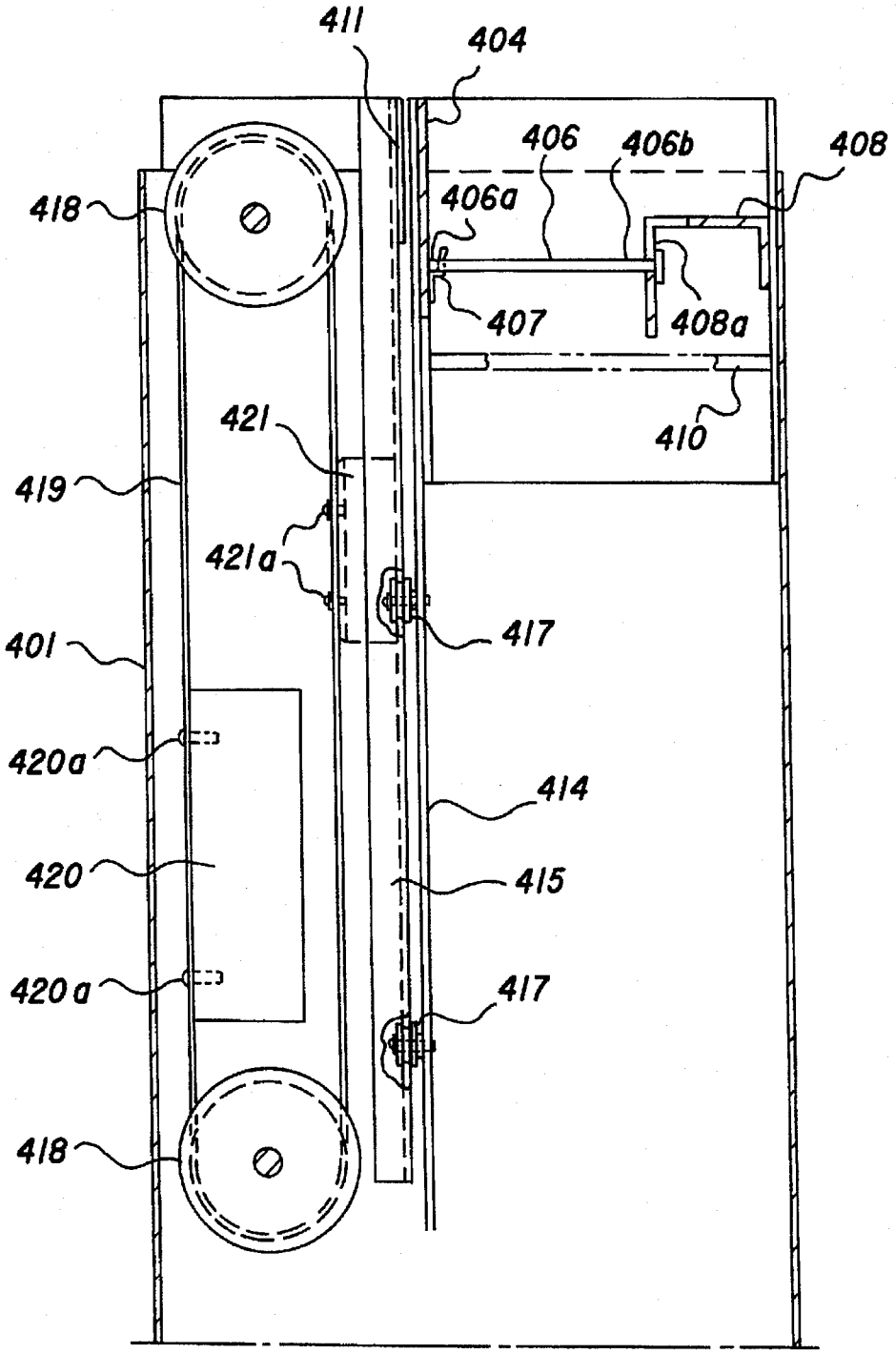
FIG. 25 is a side view showing arrangement of a plumb to make the movable support base ascend in the embodiment of FIG. 21.
Figure 26:
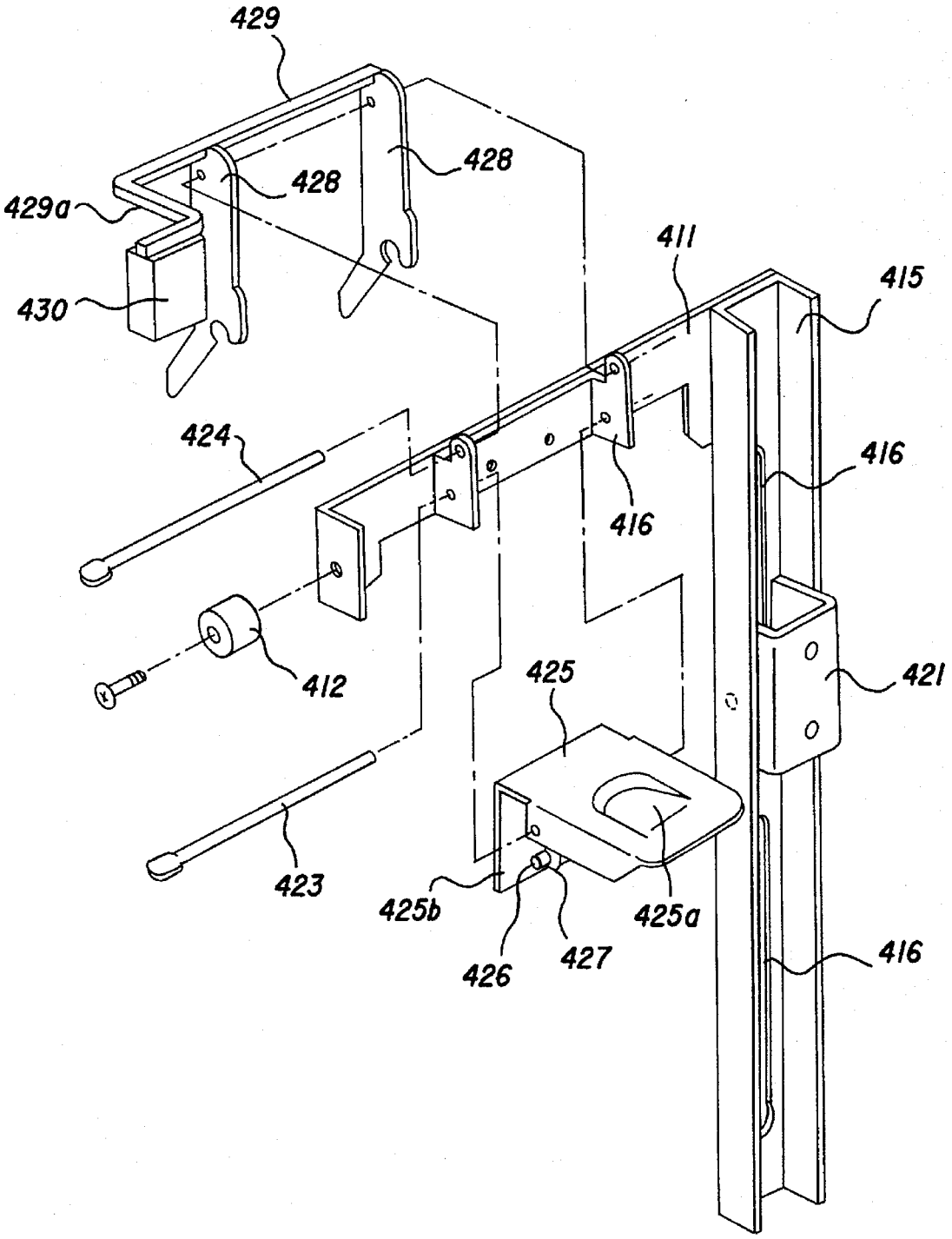
FIG. 26 is an exploded view of a pivot in the embodiment shown in FIG. 21.

As shown in FIG. 22, the hanger 406 is comprised of a bar, and the like, formed in a box type (top-open rectangle-shaped), that opens the cover 403 as shown in FIG. 25; the base 406*a* of the box type hanger 406 is anchored to a hook 407 mounted on a fixed support base 404; and the hanger is installed by hitching both ends 406*a*, 406*b* to anchor holes 408*a* of the support member 408 fixed to the fixed support base 404 so that it can be removed.

On the other hand, as shown in FIG. 27, the upper part of a wrapping bag 405 has an opening 405*a*; the upper end 451*a* of the fore side 451 of the opening is folded forward in U-shape; the upper end 452*a* of the rear side 452 is projected above that of the fore side 451 and a pair of locking holes 405*b* are provided at the upper end of the projected portion.

As shown in FIG. 22 and FIG. 24, a number of wrapping bags are suspended for storage by inserting an opposing member of the box type hanger 406 into each locking hole 405*b*.

A movable pressure plate 409 is provided along a pair of guide bars 410, 410 on the rear face of a wrapping bag 405 and the pressure plate 409 is constantly pressed towards the rear face of wrapping bag 405 by a coil spring 410*a* penetrating into each guide bar.

As shown in FIG. 22 and FIG. 23, a box type guide rail 413 is installed at one horizontal end of the front face of the fixed support base 404; a support member 414 is installed at the other horizontal end of the front face of the base 404; a movable support base 411 is arranged on the front face of the fixed support base 404. The movable support base 411 mounts a rotating roller 412 inside the guide rail 413 at one end; as shown in FIG. 23, a pair of long holes 416, 416 are vertically formed on the box type guide member 415 mounted on the other end of the moveable support base 411; and the movable support base 411 is retained vertical to the fixed support base 404 by hitching a grooved roller 417 to support member 414.

In addition, a pair of pulleys 418, 418 are installed vertically on support member 414 forward of guide member 415 as shown in FIG. 22 and FIG. 25; a plumb 420 is mounted by screws 420*a*, and the like, on one side of a belt 419, tensed and rotated with both pulleys 418, 418; and movable support base 411 moves vertically by connecting the other side of the belt 419 with a connecting member 421 fixed to guide member 415 by using screws 421*a* and the like.

A drawing, showing a stopper, mounted on the fixed support base 404, to anchor the movable support base 411 at the fixed position as shown in FIG. 23 so as to limit the ascending motion of the movable support base 411, is omitted. In FIG. 22 and FIG. 23, signs 413*a* and 414*a* are stoppers which are formed by bending forward one end of the guide rails 413 and the support member 414 to limit the descending motion of the movable support base 411.

As shown in FIG. 22 and FIG. 24, a pair of supporting axes 423, 424 are provided on the upper central front face of movable support base 411 through a bearing 416; a movable wear plate 425, which lowers the movable support base 411 by contacting with a shoe at the edge of umbrella, is provided on a supporting axis 423.

Concave 425*a*, which contacts with the shoe at the edge of umbrella, is formed on the upper central face of the wear plate 425; a curvature 425*b* from which is vertically lowered between the movable support base 411 and the fixed support base 404, as shown in FIG. 24, is provided at the rear part of the wear plate 25.

At the bottom o the curvature 425*b*, a movable roller 427 is provided through an axis 426 anchored by welding and the like; the upper face of the wear plate can be retained horizontally by contacting the roller 427 with the front face of the fixed support base 404.

Besides, a pair of open control levers 428, 428, which open the openings by entering into the opening 405*a* of said wrapping bag 405, are provided on the other supporting axis 424 to be movable in both sides of the wear plate 425; both levers 428, 428 are connected on the upper end with a connecting arm 429 anchored by welding and the like.

As shown in FIG. 22, the structure is such that one end of the connecting arm 429 bends forward; by mounting a plumb 430 at the end of the curvature 429*a*, the open control lever 28 rotates in a counterclockwise direction in FIG. 24; and the lower end of the lever 28 is pressed on the front face of forefront wrapping bag suspended by hanger 406.

In addition, in the lower curvature 429*a* of the connecting arm 429, a connecting plate 431, which rotates the open control lever 428 in clockwise direction in FIG. 24, is integrally provided on the front face of guide rail 413.

Figure 27C:
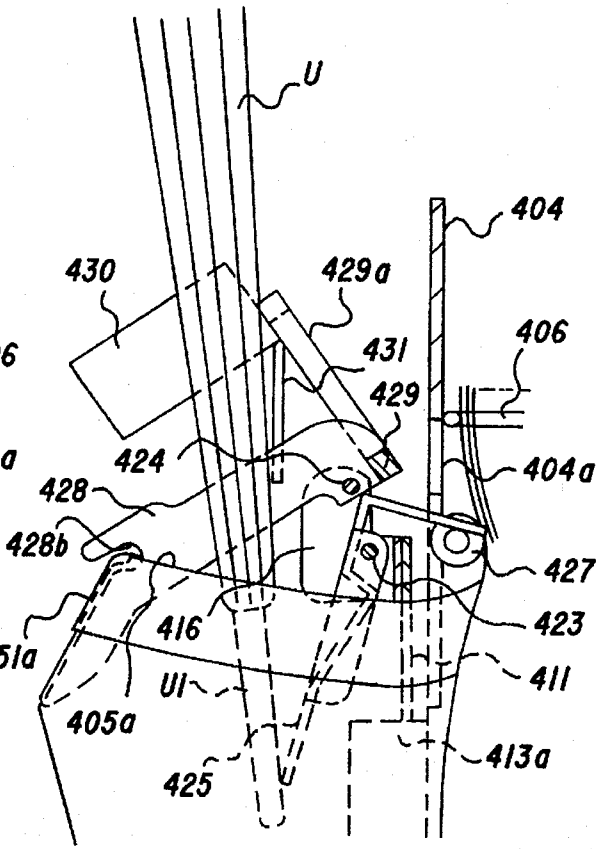
FIGS. 27(A), (B) and (C) are explanatory drawings showing different phase of the storing operation.
Figure 27B:
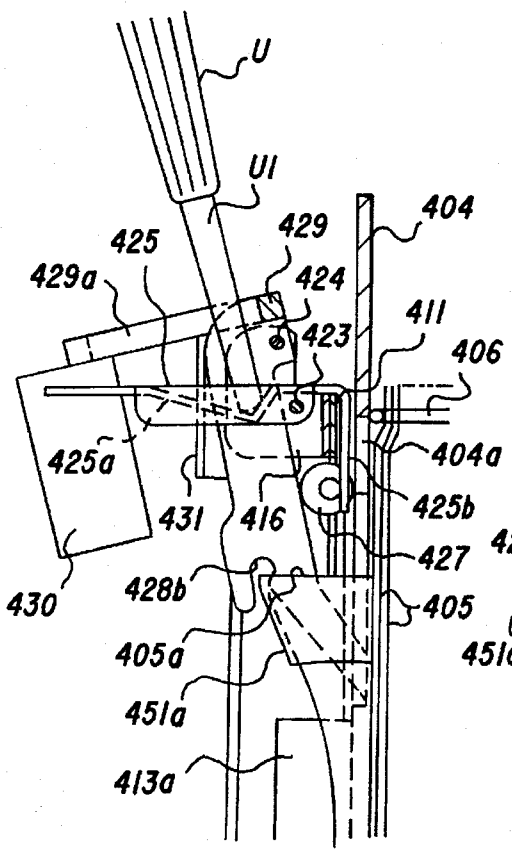
Figure 27A:
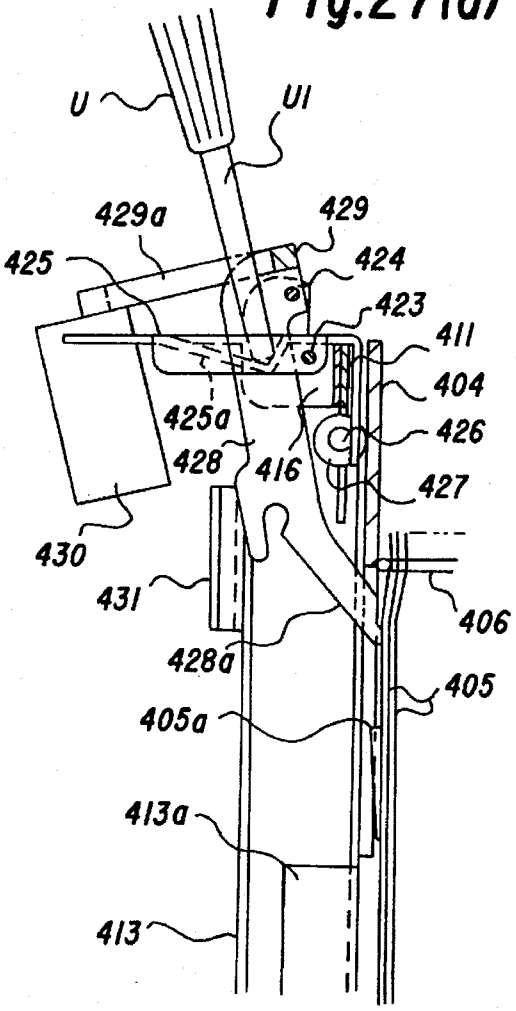

In the aforementioned embodiment, in case of storing an umbrella U into a wrapping bag 405, as shown in FIG. 27A, press the umbrella U downward by contacting the shoe U1 of the edge of umbrella U with the upper face of the concave 425*a* of the wear plate 425. Thus the roller 427 provided on the curvature 425*b* of the wear plate 425, as shown in FIG. 27B, moves downward together with the movable support base 411 against the ascending force of the plumb 420, in a state of contacting the roller 427 with the front face of the fixed support base 404 keeping the upper face of the wear plate 425 horizontal.

Accordingly, the open control lever 428 moves downward in a manner by which the end 428*a* is pressed to the upper front face of the opening 405*a* of the forefront wrapping bag 405; then, the end 428*a* of the open control lever 428 enters into the opening 405*a* of the wrapping bag 405; in this case, should the upper part 451*a* of the fore side 451 be folded, as mentioned above, the end 428*a* of said lever 428 can enter into the opening 405*a*.

When the open control lever 428 further moves downward and the end 428*a* enter the opening 405*a*, the front side 451 of the wrapping bag 405 is gradually pulled forward and the upper part 451*a* of the front side 451 enters into the concavity 428*b* formed on the open control lever 428, as shown in FIG. 27B. Simultaneously, the curvature 429*a* of the connecting arm 429 contacts with the connecting plate 431.

In the same state, when the open control lever 428 moves further downward together with the movable support base 411, the open control lever 428 and the connecting arm 429 rotate in clockwise direction in FIG. 27B around the supporting axis 424 against the descending force of the plumb 430; and the opening 405*a* of the wrapping bag 405 opens widely, as shown in FIG. 27C, in a state of entering the upper part 451*a* of the front side 451 of the wrapping bag 405 into the concave 428*b* of the open control lever 428.

Simultaneously, the wear plate 425 lowers; the roller 427 provided on the curvature 425*b* of the wear plate 425 is removed from the central convex 404*a*, FIG. 23, of the fixed support base 404; as shown in FIG. 27C, the wear plate 425 sweeps back by rotating in counterclockwise direction around the supporting axis 423; as a result, the shoe U1 of the edge of umbrella U enters into the wrapping bag 405 by slipping on the upper face of the wear plate 425 from the concave 425*a* of the wear plate 425; and finally, the umbrella U is automatically wrapped into the wrapping bag 405 by further lowering the umbrella U.

The bag 405 in which the umbrella U is wrapped can be easily taken out together with the umbrella U by pulling it out ahead of the device body 401 to remove the upper locking holes 405*b* of the wrapping bag 405 from the hanger 406.

In addition, the movable support base 411 and the open control lever 428 automatically returns to the original condition with the plumbs 420, 430 by taking out the umbrella U wrapped in the bag 405 forward; the roller 27 provided on the curvature 25*b* of the wear plate 25 moves in front of the fixed support base 404; and the wear plate 425 returns horizontal in a standby state.

Besides, the aforementioned embodiment is just an example, therefore, structural changes are possible within the purpose of the present invention. For example, according to the above preferred embodiment, the case of storing umbrellas in wrapping bags is just explained, however, the present invention is applicable to storing a variety of food stuffs such as French bread and green onions, to name a few, as well as storing umbrellas.

What is claimed:

1. A storage device for wrapping bags for comparatively long and narrow items comprising:

a device body for storing a plurality of wrapping bags for said items, said wrapping bags being long and narrow for receiving and wrapping said items, one item in each wrapping bag, said wrapping bags being openable at one end for receiving an item to be wrapped and closed at the opposite end and at opposite sides joining said openable end and said closed end; and a means for opening said openable end of each of said wrapping bags for inserting said one item into each wrapping bag;

a storage box for storing said plurality of wrapping bags and cavity means in said device body for providing space for said storage box;

said each wrapping bag at one side of said openable end having a first wall shorter than a wall at the other side of said openable end, said first wall being in engagement with said wall at the other side of said openable end, an end of said shorter wall being folded away from said wall at said other side of said openable end; and lever means for insertion between said shorter wall and said wall at said other side of said openable end for solely opening and spreading said walls for receiving said item to be wrapped.

* * * * *